US005989404A

United States Patent [19]

Kiyomiya et al.

[11] Patent Number: 5,989,404

[45] Date of Patent: Nov. 23, 1999

[54] METHOD FOR MANUFACTURING A FLUORESCENT SCREEN DISPLAY

[75] Inventors: Tadashi Kiyomiya, Saitama; Toshio Ohoshi; Masami Okita, both of Tokyo; Eisuke Negishi, Kanagawa; Satoshi Nakada, Saitama, all of Japan

[73] Assignee: Sony Corporation, Tokyo, Japan

[21] Appl. No.: 08/958,299

[22] Filed: Oct. 27, 1997

Related U.S. Application Data

[62] Division of application No. 08/497,422, Jun. 30, 1995.

[30] Foreign Application Priority Data

Jul. 1, 1994 [JP] Japan ..... P06-173706
Sep. 28, 1994 [JP] Japan ..... P06-259124

[51] Int. Cl.[6] ..... H01J 9/22; H01J 29/32

[52] U.S. Cl. ..... 205/96; 204/484; 204/490; 205/122; 205/136

[58] Field of Search ..... 204/484, 490, 204/491, 499, 500; 205/122, 136, 96

[56] References Cited

U.S. PATENT DOCUMENTS 5,453,659 9/1995 Wallace et al. ..... 313/495
5,466,358 11/1995 Kiyomiya et al. ..... 205/96

FOREIGN PATENT DOCUMENTS 0 635 865 1/1995 European Pat. Off. .

OTHER PUBLICATIONS

Patent Abstracts of Japan, vol. 950, No. 003, abstracting JP–A–07 057631, Mar. 1995.

Patent Abstracts of Japan, vol. 002, No. 150 (E–078), abstracting JP–A–53 118363, Dec. 1978.

*Primary Examiner*—Kathryn Gorgos
*Assistant Examiner*—William T. Leader
*Attorney, Agent, or Firm*—Hill & Simpson

[57] ABSTRACT

This invention relates to a fluorescent screen structure wherein a plurality of first electrodes (for example stripelike selected electrodes) having a plurality of fluorescent substances (especially fluorescent substances of different colors for a color screen) severally deposited thereon and second electrodes (for example stripelike reverse bias electrodes not for electrodeposition) not having the fluorescent substances deposited thereon between these first electrodes are provided on a common base (especially a glass substrate for a fluorescent screen panel) and a field emission display (FED) using this and methods for manufacturing these. According to the invention, even in such cases as when pillars for supporting a high vacuum are formed in an FED, a uniform fluorescent screen can be obtained without the pillars constituting an obstruction and a fluorescent substance can be deposited in such a way that it will not subsequently impair the level of a vacuum in a display in which the fluorescent screen is used and also a fluorescent substance can be deposited in a pattern such as a narrow stripe pattern having fine widths and fine pitches highly precisely and without mixed colors and with good manufacturability.

7 Claims, 23 Drawing Sheets

METHOD FOR MANUFACTURING A FLUORESCENT SCREEN DISPLAY

This is a division of application Ser. No. 08/497,422, filed Jun. 30, 1995.

BACKGROUND OF THE INVENTION

This invention relates to a fluorescent screen structure and a field emission display (FED) and methods for manufacturing these, and for example relates to a color fluorescent screen structure for various types of display and a field emission display using this fluorescent screen structure having field emission cathodes as electron sources and to methods for manufacturing this color fluorescent screen structure and display.

Generally, as methods for making fluorescent screens in color cathode ray tubes (including monochrome tubes), slurry methods, printing methods or electrodeposition have been used.

However, with a fluorescent screen panel for an FED, many column-shaped bodies several hundreds of $\mu$m tall called pillars which withstand the high vacuum inside the panel and support the vacuum are formed before the fluorescent substances are applied, and it is necessary to coat the fluorescent substances in the gaps between these numerous pillars.

Because of this, with the slurry methods and printing methods that have been used conventionally, the pillars constitute solid obstructions in the process and it has been difficult to form an even fluorescent screen. Furthermore, because an organic material has been used as the bonding material, it has not been possible to completely remove this material just by burning it off in a baking step. For example, when forming a color fluorescent screen in an FED it is necessary to maintain an ultra-high vacuum of about $10^{-8}$ Torr inside the display, but with slurry methods there has been the problem that gas emitted by the fluorescent screen as a result of the presence of the organic material mentioned above causes the vacuum to deteriorate.

With the electrodeposition method it is possible to coat a fluorescent substance onto predetermined areas (areas of an electrode pattern) irrespective of the existence of the pillars, and because there is no gas emission from the coated film it is also possible to maintain a high vacuum. The present inventors have already proposed forming a fluorescent screen for an FED by making the best use of the advantages of the electrodeposition method (Japanese Patent Applications Nos. H.4-225994, H.6-76738). According to a method disclosed in these previous applications, when electrodepositing a fluorescent substance of a certain color on selected electrodes, by applying a zero or reverse polarity voltage (reverse bias) on non-selected electrodes on which the fluorescent substance is not to be electrodeposited, unwanted adhesion of the fluorescent substance to the non-selected electrodes can be prevented.

With this electrodeposition method, a fluorescent substance to be deposited is dispersed in a water-soluble or non-water-soluble electrodeposition solution containing an electrolyte (added to positively or negatively charge the fluorescent substance); bodies to be electrodeposited on (electrodes on the inner side of a panel) and an opposing electrode are disposed facing each other in the electrodeposition solution with an inter-electrode distance normally of the order of several tens of mm provided therebetween, and a fluorescent screen is formed by electrodepositing the fluorescent substance onto the electrodes with the electrode side being given a negative potential and the opposing electrode side being given a positive potential when the fluorescent substance is charged positively and the electrode side being given a positive potential and the opposing electrode side being given a negative potential when the fluorescent substance is charged negatively.

For example, as proposed in Japanese Patent Publication No. S.60-11415, to form a color fluorescent screen consisting of fluorescent substances of the colors green, blue and red, fluorescent substances of these three colors are electrodeposited one after another on stripelike transparent electrodes by repeating the above process for each of the colors.

However, the present inventors have discovered as a result of studies into techniques for coating a fluorescent substance onto a fluorescent screen panel by this electrodeposition method that there are the following problems to be solved:

First, for such reasons as that conventionally electrodeposition has been carried out with the opposing electrode (facing electrode) only disposed parallel to the fluorescent screen panel surface with a predetermined distance (for example of the order of 40 to 50 mm) therebetween and that during electrodeposition the charged fluorescent substance particles actually involved in electrodeposition brought about by electrophoresis are only those within a small distance from the surface being electrodeposited on (this distance varies with the electrodeposition time but at the most is about 1 mm), the fine control of the field strength applied to the charged fluorescent substance particles necessary to achieve an electrodeposition coating on a narrow stripe pattern with good precision is difficult and as a result it has not always been possible to realize the even formation of a very fine fluorescent screen.

Also, in electrodeposition onto electrodes of narrow stripe pattern, the spaces between the stripes also naturally are narrow, and with conventional electrodeposition methods there has been the problem that electrodeposition is also carried out on spaces around the stripe electrodes to be electrodeposited on and on adjacent stripe electrodes, and mixed colors tends to occur.

There has also been the problem that because the opposing electrode is disposed a fixed distance from the fluorescent screen panel surface the electrodeposition tank itself is large, a large quantity of solution is used and consequently it is difficult to uniformly stir and circulate the electrodeposition solution.

SUMMARY OF THE INVENTION

An object of this invention is to provide a fluorescent screen structure and a field emission display (FED) and manufacturing methods for these with which even in such cases as when in an FED pillars for supporting a high vacuum are formed a uniform fluorescent screen can be obtained without the pillars constituting an obstruction and a fluorescent substance can be deposited in such a way that it does not subsequently impair the vacuum and also a fluorescent substance can be deposited in a pattern such as a narrow stripe pattern having fine widths and fine pitches highly precisely and without mixed colors and with good manufacturability.

Specifically, this invention relates to a fluorescent screen structure wherein a plurality of first electrodes (for example stripelike selected electrodes) each coated with one of a plurality of fluorescent substances (especially fluorescent substances of different colors for a color screen) and second electrodes (for example reverse bias electrodes not for electrodeposition) not coated with any fluorescent substances between these first electrodes are provided on a common base (especially a glass substrate for a fluorescent screen panel).

In a fluorescent screen structure according to the invention, it is preferable that fluorescent substances of a plurality of colors (especially red, green and blue) are selectively coated onto transparent first electrodes (for example stripelike indium tin oxide electrodes) corresponding to these colors, and second electrodes (for example reverse bias electrodes not for electrodeposition) adjacent to these transparent first electrodes and not coated with any fluorescent substances consist of at least either electrodes integrated with lower parts of column bodies (for example pillars) for vacuum support provided between groups of fluorescent substances each consisting of sets of fluorescent substances of the plurality of colors or electrodes provided within the sets of fluorescent substances of the plurality of colors between these fluorescent substances (for example electrodes of multifunctional structure for field strength fine control).

Preferably, the second electrodes are provided on the same surface on the inner side of a common fluorescent screen panel as the plurality of transparent first electrodes. Also, it is desirable that the fluorescent substances of the plurality of colors constitute a color fluorescent screen, and the plurality of transparent first electrodes and the second electrodes adjacent thereto are each stripelike.

Also, this invention provides a field emission display comprising a fluorescent panel having a fluorescent screen structure based on the invention as described above and a panel having an electrode structure comprising field emission cathodes.

The invention also provides as a method for manufacturing a fluorescent screen structure or a field emission display based on the invention a manufacturing method comprising the steps of: providing a plurality of first electrodes (for example stripelike selected electrodes) for severally being coated with one of a plurality of fluorescent substances (especially fluorescent substances of different colors for a color screen) and second electrodes (for example reverse bias electrodes not for electrodeposition) not to be coated with any fluorescent substances between these first electrodes on a common base (for example a glass substrate for a fluorescent screen panel); and selecting prescribed electrodes among the plurality of first electrodes and depositing the fluorescent substances onto the selected electrodes by carrying out electrodeposition in an electrodeposition solution with the electrodes other than these selected electrodes as opposing electrodes.

In this manufacturing method according to the invention, in a non water-soluble or water-soluble electrodeposition solution, preferably a voltage is applied on the selected first electrodes to control the electrical field in the vicinity of these first electrodes and a reverse bias voltage is applied on electrodes other than the selected first electrodes. In this case, it is also good to dispose a third electrode facing the base surface on which the first electrodes and the second electrodes are mounted with a predetermined gap provided therebetween and apply a reverse bias voltage on this third electrode also. By applying a bias voltage on this third electrode, the freedom with which the strength of the field in the vicinity of the selected electrodes can be controlled is increased and it is possible to form a finer fluorescent screen.

Also, it is preferable to carry out pretreatment to prevent deterioration of the first electrodes on the electrodeposition solution.

It is preferable that the first electrodes and the second electrodes be provided on the same surface on the inner side of a common fluorescent screen panel, and these can be formed by lithography or printing or the like. When the first electrodes and the second electrodes serving as opposing electrodes are provided on the same surface, the electrodeposition tank and hence the whole apparatus can be made compact and furthermore the amount of electrodeposition solution used can be reduced and uniform stirring and circulation become easy.

Specifically, a fluorescent screen structure according to the invention can be produced in the following way: An electrodeposition method is used in which a conventionally disposed opposing electrode is basically dispensed with (however, it is possible to use this kind of opposing electrode as well), and instead, as opposing electrodes opposing selected stripelike electrode parts (a group of electrodes for any specified color) for electrodeposition formed in an effective picture area of the fluorescent screen panel, a controlled d.c. voltage is applied on non-selected stripelike electrode parts (groups of electrodes for other colors) on both sides (or on one side) of the selected electrode parts and/or on electrode parts (mainly stripelike electrodes) formed beforehand between the stripe electrodes for electrodeposition.

In this case, by forming the opposing electrodes on the same plane by lithography or printing or the like, the inter-electrode distance precision can be greatly increased, and because fine control of the electric fields to the selected electrodes becomes possible electrodeposition onto a very fine pattern can be carried out with good precision.

Also, by applying a d.c. bias voltage to all the electrodes other than the selected electrodes it is possible to prevent non-electrostatic (resulting from an action other than Coulomb force) adhesion of the fluorescent substance between the stripe electrodes and to the stripe electrodes for other colors. As the fluorescent screen, any screen with stripelike fluorescent substances sequentially arrayed in one direction or a pattern which can provide an electrical field from around the electrodes to be electrodeposited on (on the same plane) to the electrodes to be deposited on is suitable.

In the invention, first, a plurality of narrow stripelike transparent electrodes for being electrodeposited on corresponding to fluorescent substances of different colors and guard electrodes around these electrodes (in the non-effective picture area) can be adhered to the inner side of a fluorescent screen panel of an FED; then, between these stripes for being electrodeposited on and between trios (sets of stripes each consisting of one stripe for each color), layered bodies can be formed by layering black stripes (insulating layer) onto conducting stripes (conducting layer) in this order, and pillars (insulating layer) for supporting a vacuum can be formed on these layered bodies in predetermined positions, for example between trios (or every few trios).

After that, by preparing an electrodeposition solution with a fluorescent substance corresponding to a color dispersed therein for each color and carrying out electrodeposition in the respective electrodeposition solutions by applying a negative potential (may alternatively be a positive potential) to selected electrodes (stripe electrodes to be electrodeposited on) and applying an optimum d.c. reverse bias potential to the non-selected electrodes (the electrodes on either side of the electrodes to be electrodeposited on and all the other electrodes) and the guard electrode, it is possible to deposit the prescribed fluorescent substances on narrow stripe electrodes with good precision, uniformly and without mixed colors.

This is because the electrodes on the same plane as and on either side of the stripe electrodes to be electrodeposited on act as opposing electrodes, and furthermore as a result of fine control of the electrical field the fluorescent substances adhere to the selected electrodes only, with good precision. In this way, fluorescent substance adhesion to a very fine stripe pattern can easily be realized.

DETAILED DESCRIPTION OF THE PREFERRED EMBODIMENTS

Preferred embodiments of the invention will now be described with reference to the accompanying drawings.

FIG. 1 through FIG. 22 show a first preferred embodiment of the invention applied to the uniform formation of a very fine color fluorescent screen.

(brief description of FED panel)

First, the constitution of an FED (field emission display) will be briefly described with reference to FIG. 12 through FIG. 20.

An FED is a thin, flat display device which performs light-emitting display by using minute so-called Spindt type field emission cathodes of which the cathode size is a few $\mu$m or less to discharge electrons and accelerating them toward and onto a surface consisting of a fluorescent substance.

Figure 12:
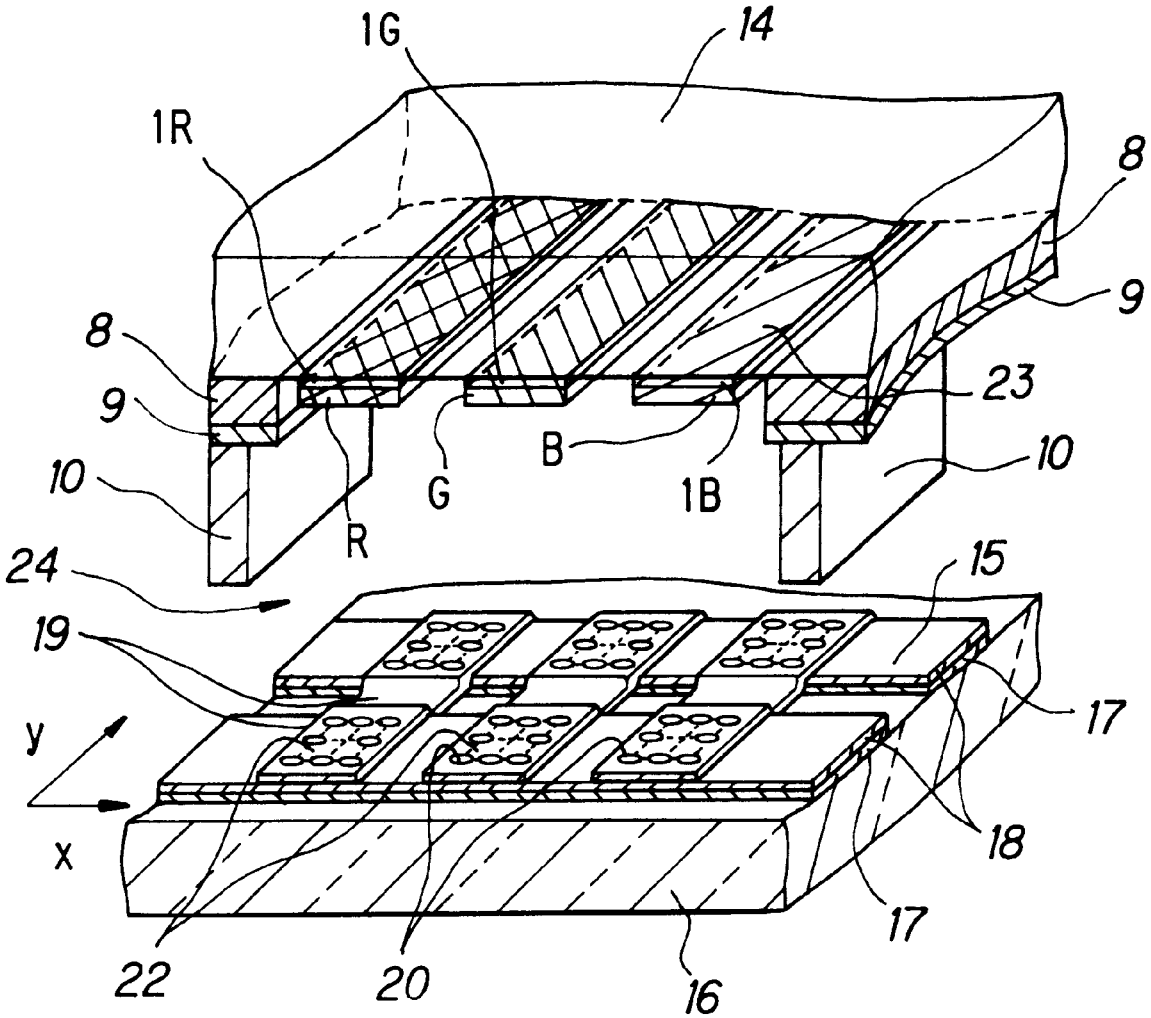
FIG. 12 is an exploded perspective view of an example of a field emission display.

FIG. 12 is an exploded perspective view of an example of an FED. In this FED, a transparent fluorescent screen panel 14 on which is formed a color fluorescent screen 23 comprising fluorescent substance elements of for example the three primary colors R (red), G (green) and B (blue) arrayed in stripe form on transparent electrodes 1R, 1G, 1B made of ITO (Indium Tin Oxide: a mixed oxide of In and Sn) or the like and a rear panel 16 on which is formed an electrode structure 15 having field emission cathodes are airtightly sealed by sealing members or the like and a predetermined level of vacuum is maintained therebetween.

The fluorescent screen panel 14 and the rear panel 16 are held a predetermined distance apart by columns (so-called pillars) 10 of a predetermined height. These pillars 10 are mounted on electrodes (reverse bias electrodes during electrodeposition) 9 formed on insulating layers 8, which constitute black stripes, the electrodes 9 being of the same pattern as the insulating layers 8, between trios made up of a fluorescent substance element of each of the three primary colors R. G, B.

The electrode structure 15 comprises bandlike cathode electrodes 17 arrayed in parallel in stripe form extending for example in the direction shown by the x-axis in FIG. 12 on the inner side of the rear panel 16, and bandlike gate electrodes 19 arrayed on insulating layers 18 on the cathode electrodes 17 in parallel in stripe form in the y-axis direction, substantially orthogonal to the cathode electrodes 17.

Figure 13:
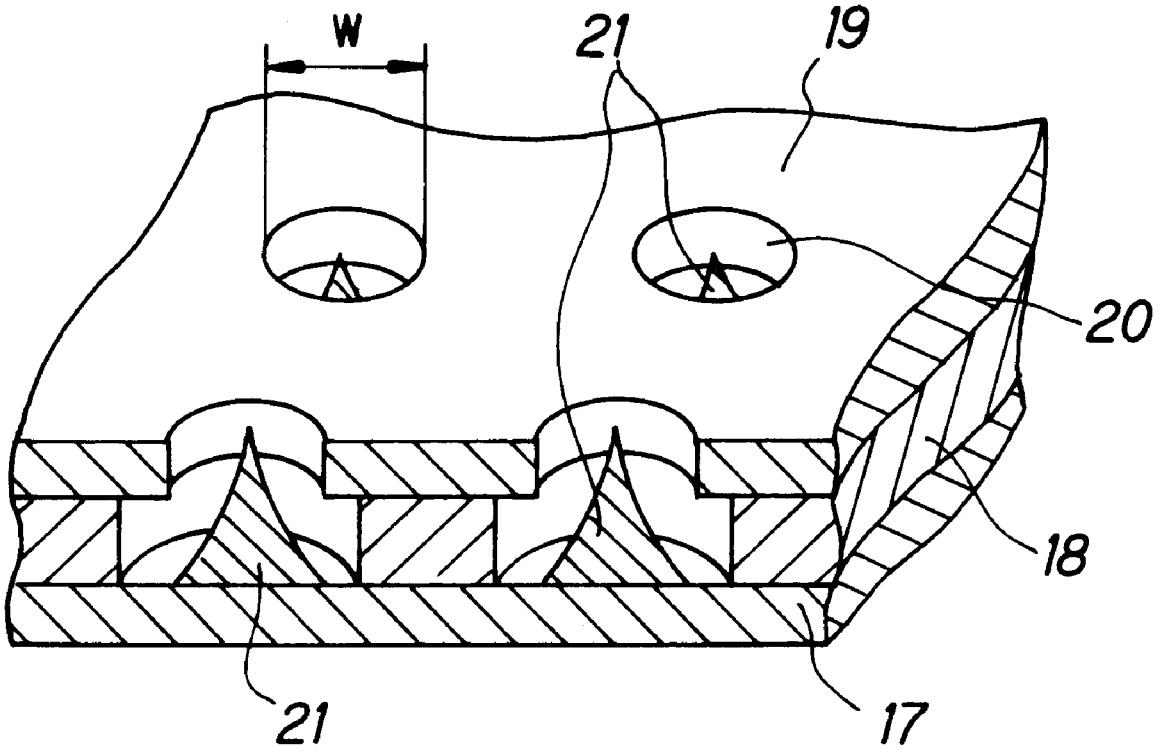
FIG. 13 is a schematic enlarged perspective view of a detail of the field emission display.

For example a plurality of fine holes 20 of predetermined opening width w are provided in the gate electrodes 19 at the intersections 22 of the cathode electrodes 17 and the gate electrodes 19 in correspondence with the fluorescent substance elements of the three primary colors R, G, B in the fluorescent screen. In these fine holes 20, for example as shown in FIG. 13 in schematic enlarged perspective detail view, conical field emission cathodes or so-called microchips 21 are formed by deposition on the cathode electrodes 17.

Figure 14:
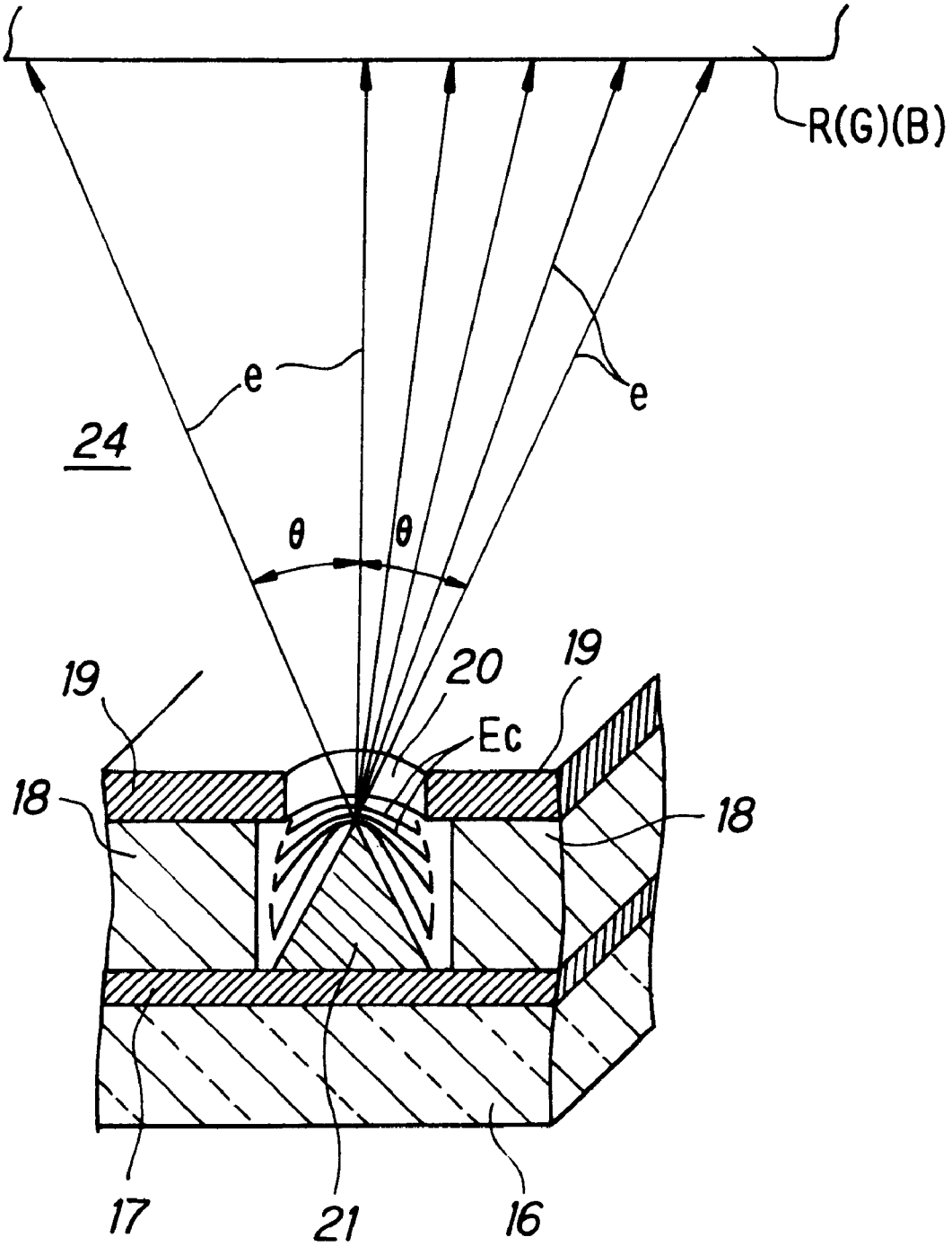
FIG. 14 is a schematic sectional perspective view illustrating the electron emission performance of an electron emission source.

Here, as shown in FIG. 14, because the microchips 21 disposed on the cathode electrodes 17 in the fine holes 20 are conical and extend through substantially the thickness of the insulating layer 18, when a voltage is applied across a gate electrode 19 and a cathode electrode 17, equipotential surfaces Ec are formed in the fine holes 20 along the conical surfaces of the microchips 21.

Because electrons e emitted by the microchips 21 advance perpendicular to the equipotential surfaces Ec, the paths of the electrons e emitted through the fine holes 20 incline and this angle of inclination θ may become as large as ±30°. As a result, at the fluorescent screen, mislanding, wherein electrons e do not reach their intended fluorescent substance (for example a red fluorescent substance) and instead reach an incorrect fluorescent substance (for example an adjacent green fluorescent substance), tends to occur. If this happens, light emission of the target color is not obtained and the performance of the display is impaired, and this is an obstacle to making finer displays.

Furthermore, in the electron emission source described above, the quantity of electrons (i.e. the electrical current) emitted from the microchips 21 tends to vary among microchips 21. As a result, the brightness of the screen of this kind of display is nonhomogeneous and offensive to the eye.

Also, it sometimes happens that metal particles and the like produced during the manufacture of the electron emission source described above cause the microchip 21 and the gate electrode 19 to short-circuit, damaging the microchip 21. In addition to this, it sometimes happens that ions existing in the high vacuum region 24 between the gate electrode 19 and the fluorescent screen panel 14 sputter the microchip 21, shortening the life of the display.

Figure 15:
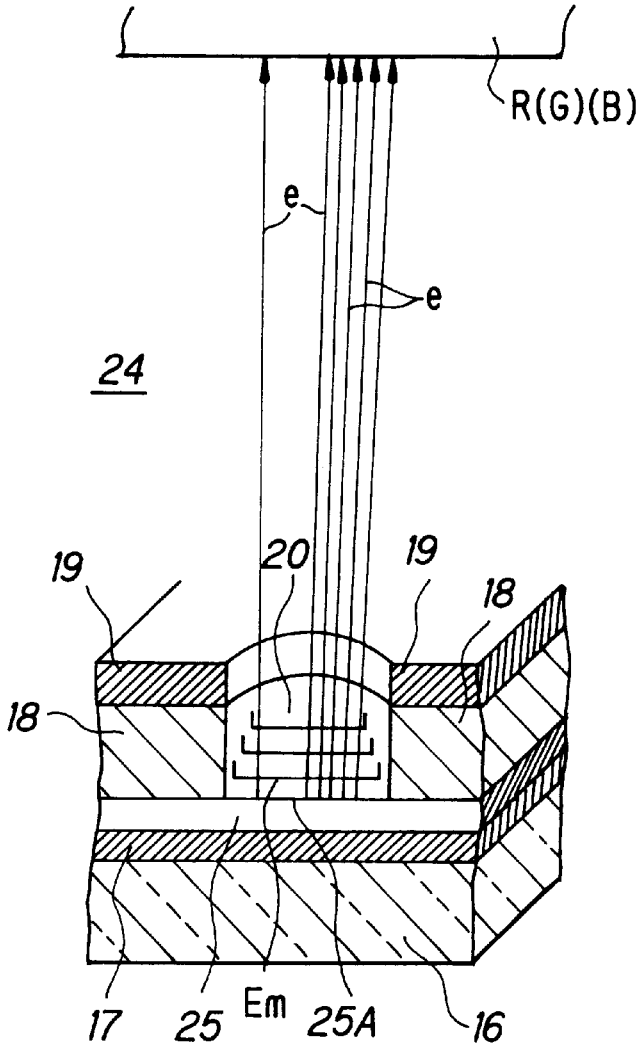
FIG. 15 is a schematic sectional perspective view illustrating the electron emission performance of another electron emission source.

Because of this, it is preferable that instead of the microchips 21 a thin film 25 made of a particle-emitting thin film material be used as the electron emitting cathodes, as shown in FIG. 15. An example of a method for manufacturing this kind of electron emission source will now be described with reference to FIG. 16 through FIG. 20.

Figure 16:
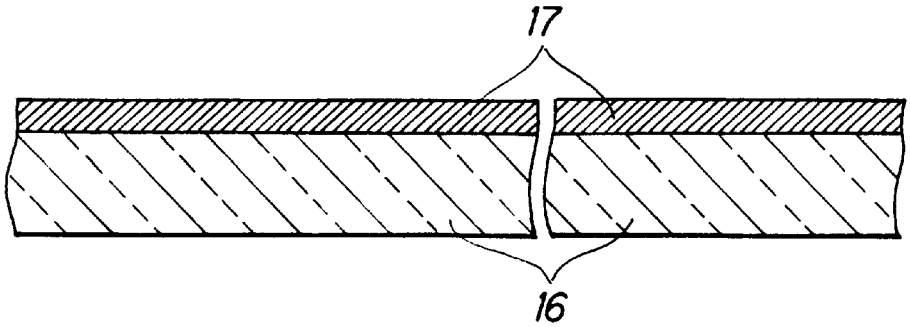
FIG. 16 is a schematic sectional view showing a stage in the manufacturing process of the electron emission source shown in FIG. 15.

First, as shown in FIG. 16, a film of a conductive material such as niobium, molybdenum or chrome is formed to a thickness of 2000 Å on a base substrate 16 made of glass or the like. This conductive film is then processed into lines by photolithography or reactive ion etching or the like (for example using a mixed gas of $Cl_2$ and $O_2$) to form cathode electrode lines 17.

Figure 17:
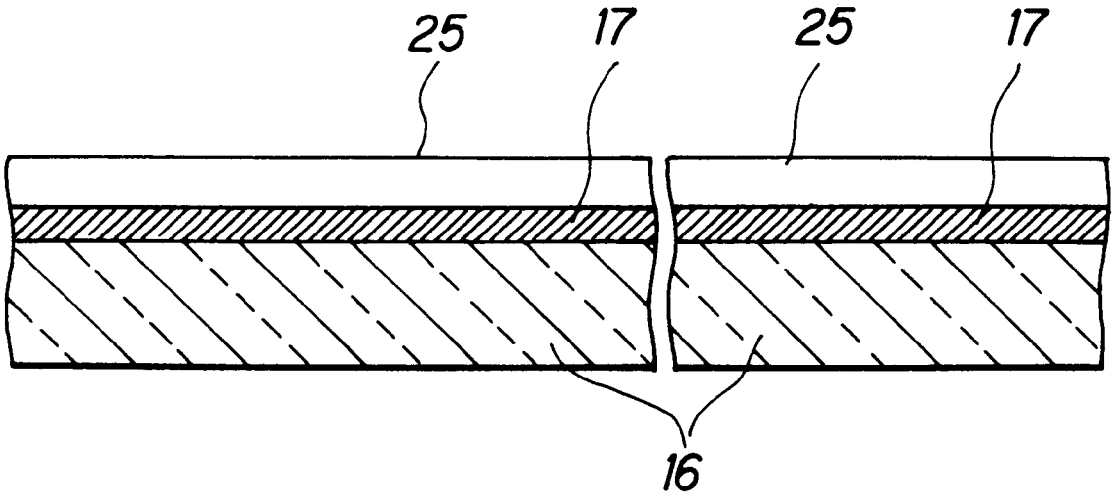
FIG. 17 is a schematic sectional view showing another stage in the manufacturing process of the same electron emission source.

Next, as shown in FIG. 17, a cold cathode thin film 25 consisting of for example a diamond thin film is formed on the cathode electrode lines 17 to a thickness of about 2000 Å by chemical vapor deposition (CVD) or the like. This thickness of thin film should be set so as to realize the benefits of the invention, and can be controlled by way of the amount of vapor deposition during film-forming. The reaction gas used in this CVD is a mixed gas of $CH_4$ and $H_2$ or a mixed gas of CO and $H_2$, and a diamond thin film 25 is deposited by thermal decomposition of this reaction gas.

After that, by photolithography and reactive ion etching, the cold cathode thin film 25 is patterned into lines so that the cold cathode thin film 25 covers the cathode electrode lines 17 except for connection terminals 17*a* thereof. Alternatively, this cold cathode thin film 25 may be formed so that it covers the cathode electrode lines 17 only at the intersections 22 of the cathode electrode lines 17 and the gate electrode lines 19, i.e. the pixel regions.

Figure 18:
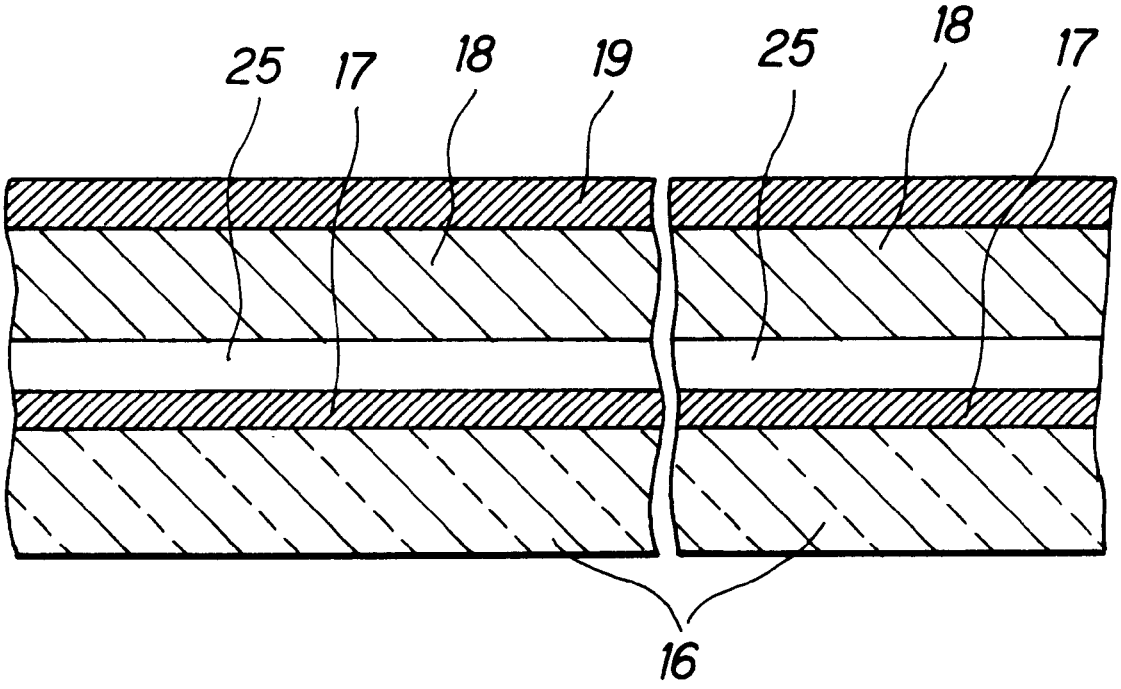
FIG. 18 is a schematic sectional view showing another stage in the manufacturing process of the same electron emission source.

Next, as shown in FIG. 18, an insulating film 18 of for example silicon dioxide ($SiO_2$) is formed to a thickness of 1 μm on the whole surface, including the cold cathode thin film 25, by sputtering or CVD, and a gate electrode material 19 of for example niobium or molybdenum is formed to a thickness of 2000 Å on the insulating film 18.

Figure 19:
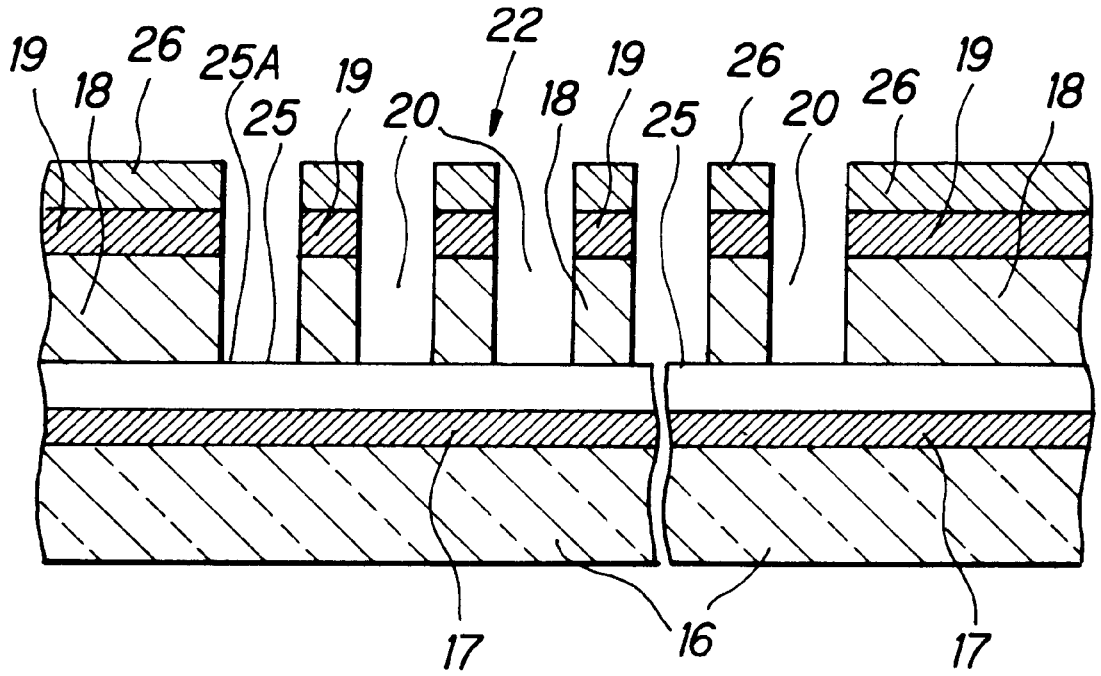
FIG. 19 is a schematic sectional view showing another stage in the manufacturing process of the same electron emission source.

Then, as shown in FIG. 19, by photolithography and reactive ion etching this gate electrode material film 19 is processed into gate electrode lines 19 intersecting with the cathode electrode lines 17. Cylindrical fine holes 20 passing through the gate electrode lines 19 and the insulating film 18 are then formed by photolithography and reactive ion etching (for example using a mixed gas of $CHF_3$ and $CH_2F_2$) (in FIG. 19, the reference numeral 26 denotes photoresist). Fine grooves can be available instead of cylindrical fine holes.

Figure 20:
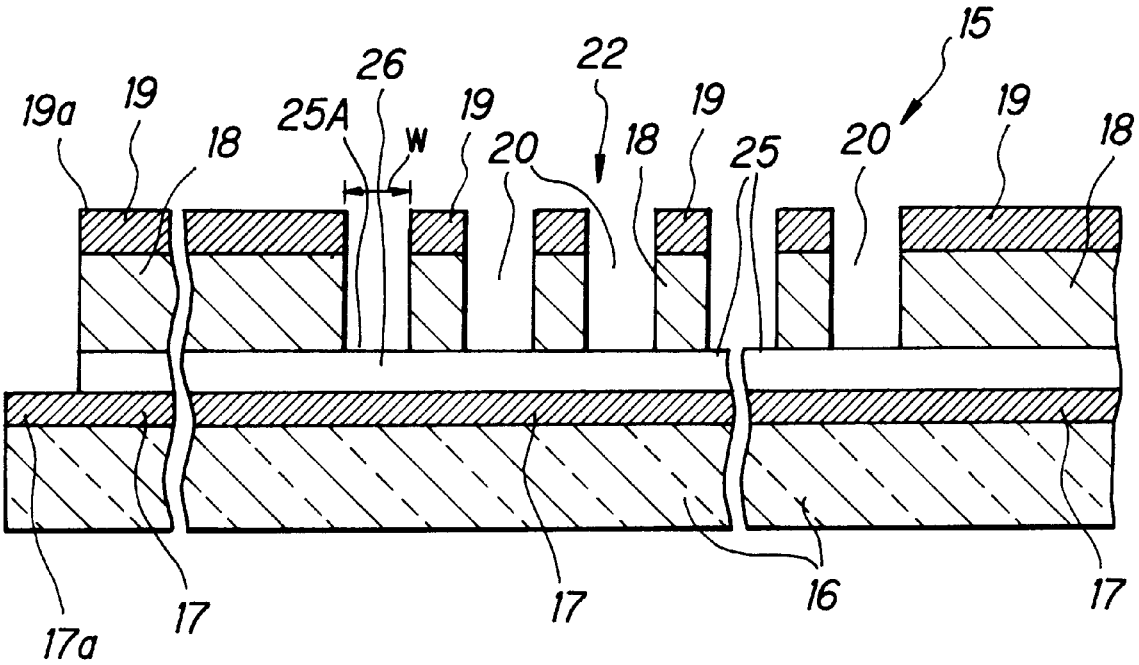
FIG. 20 is a schematic sectional view of the same electron emission source.

Next, the photoresist 26 is removed, and as shown in FIG. 20 an electrode structure 15 (electron emission source) having cold cathode thin film 25 covering the cathode electrode lines 17 and exposed in the fine holes 20 as small cold cathodes is completed.

The materials and thicknesses of the thin films and the cathode electrodes and the methods by which they are formed may be variously changed. For forming the films, besides CVD there are alternatives such as laser ablation (a deposition method using etching by laser irradiation; for forming a diamond thin film, a graphite target can be used) and sputtering (for example sputtering using Ar gas; for a diamond thin film, a graphite target can be used).

In FIG. 20, a thin film (for example the diamond thin film 25, which will be further discussed later) made of a particle-emitting material of lower work function than the material constituting the cathode electrodes 17 is provided over substantially all of the regions where the cathode electrodes 17 and the gate electrodes 19 overlap and so that it is partially exposed in the fine holes 20.

As shown in FIG. 15, because the thin film 25 on the cathode electrode 17 exposed in the fine holes 20 is extremely thin and the upper surface 25A thereof is flat, when a voltage is applied across the gate electrode 19—cathode electrode 17, substantially flat equipotential surfaces Em are formed in the fine holes 20.

Therefore, because the electrons e emitted by the thin film 25 advance perpendicular to the equipotential surfaces Em, there is little inclination of the paths of the electrons e emitted through the fine holes 20 and the electrons e pass through the high vacuum region 24 and reach their intended fluorescent substance (for example the red fluorescent substance) and there is no mislanding. As a result, light of the target color is always emitted, the performance of the display is improved and it becomes possible to make a finer display.

Furthermore, because in the electron emission source described above small cold cathodes of the thin film 25 are exposed in numerous cylindrical fine holes 20 passing through the gate electrode lines 19 and the insulating film 18 and these small cold cathodes are electrically connected to the cathode electrode lines 17 and the thin film 25 is made of a material such as amorphous diamond which is of lower work function than the cathode electrodes 17, the voltage applied across the cathode electrodes 17—gate electrodes 19 can be made low (even a few tens of volts or less) and a satisfactory quantity of emitted electrons (i.e. electrical current) can still be stably obtained.

In this case, the cathode electrode lines 17 are covered by the small cold cathodes of the cold cathode film 25 and the cylindrical fine holes 20 are formed passing through the gate electrode lines 19 and the insulating film 18; however, especially when the thin film 25 is made of amorphous diamond, because the cold cathodes themselves are resistors, the currents emitted by the thin film 25 in the fine holes 20 are made uniform. As a result, the brightness of the screen of the display is uniform and the display has very good viewability.

Also, because the amorphous diamond thin film is chemically inactive and not readily sputtered by ions produced in the high vacuum region 24, stable emission can be maintained for a long time. Because the thin film 25 itself is thin and is at the bottom of the fine holes 20, the thin film 25 is not readily sputtered in this way.

Because the parts which emit the particles are made a thin film and this thin film 25 is provided over at least substantially all the areas where the cathode electrode 17 and the gate electrode 19 overlap, whereas the microchips 21 are formed by vapor deposition after the fine holes 20 are formed, the processes from forming the insulating film 18 to forming the gate electrode 19 and the fine holes 20 can be carried out after the thin film 25 is formed in advance. Therefore, as well as it being easy to form the thin film 25, there is no short-circuiting due to adhesion of metal fragments produced during manufacture and furthermore even if metal fragments are produced by some other cause short-circuiting will not occur because the thin film 25 and the gate electrode 19 are amply far apart. As a result, there is no fusing of the electrodes when the applied voltage is raised, and reliable operation can be obtained.

Also, because the parts which emit the particles are the thin film 25, there is no concentrating of ions at one point like at the ends of the microchips 21, and because the proportion of ions existing in the high vacuum region 24 which reach the thin film 25 and sputter the thin film 25 is far lower, a device having a longer life can be made.

The thin film made of a particle-emitting material may at least cover the cathode electrodes only in the regions where the cathode electrodes and the gate electrodes overlap. In this case, the thin film made of a particle-emitting material can be provided between the cathode electrodes and the insulating layer.

The cathode electrodes may at least be provided in the parts of the regions where the cathode electrodes and the gate electrodes overlap where no fine hole exists. In this case, the cathode electrodes may cover at least a part of the thin film made of a particle-emitting material, and the cathode electrodes can be provided between the thin film made of a particle-emitting material and the insulating layer. Also, the cathode electrodes may be formed in a lattice pattern around the regions where the fine holes exist.

A preferred embodiment of the invention is described above, but various changes may be made to the preferred embodiment described above based on the technological concept of the invention.

It is essential that the work function of the particle-emitting material be smaller than the work function of the material constituting the cathode electrodes 17; preferably it is below 3.0 eV, and more preferably below 2.0 eV. This is because the voltage applied across the electrodes (the cathode electrodes 17 and the gate electrodes 19) is reduced and the required current can be obtained especially preferably with a voltage of a few tens of volts, making the device fully operable for a display, for example. Examples of materials which can be used as the material constituting the cathode electrodes 17 include Nb (work function 4.02 to 4.87 eV), Mo (work function 4.53 to 4.95 eV) and Cr (work function 4.5 eV).

As this particle-emitting material, diamond (especially amorphous diamond: work function 1.0 eV or lower) is good. When the thin film is an amorphous diamond thin film, because the current required for a display can be obtained at a field strength of less than $5\times10^7$ V/m, lower voltage operation is possible.

Also, because such an amorphous diamond thin film is electrically resistant, it is possible to make the currents emitted from the thin film in the fine holes more uniform. Because an amorphous diamond thin film is chemically inactive and therefore not readily sputtered by ions, stable emission can be maintained over a long period.

Examples of particle-emitting materials other than diamond which can be used include $LaB_6$ (work function: 2.66 to 2.76 eV), BaO (work function: 1.6 to 2.7 eV), SrO (work function: 1.25 to 1.6 eV), $Y_2O_3$ (work function: 2.0 eV), CaO (work function: 1.6 to 1.86 eV), BaS (work function: 2.05 eV), TiN (work function: 2.92 eV) and ZrN (work function: 2.92 eV).

These particle-emitting materials are characterized in that their work functions are considerably lower than those of the molybdenum (work function: 4.6 eV) and the like used as the material constituting the microchips 21 discussed above. It is preferable that this work function be made lower than 3.0 eV, but this can be decided based on its correlation with the voltage to be applied across the electrodes; when the work function is low, the applied voltage can be made low (for example, if the work function is made less than 2.0 eV the applied voltage can be made less than 100 V), and when the work function is high this can be compensated for by raising the applied voltage.

As methods for effecting color display with this FED there is a method wherein the cathodes of a selected intersection 22 are in correspondence with a fluorescent substance of one color and the so-called color selection method wherein the cathodes of a selected intersection 22 are in correspondence with fluorescent substances of a plurality of colors. The operation of the color selection method in this case will now be described with reference to FIG. 21 and FIG. 22.

Figure 21:
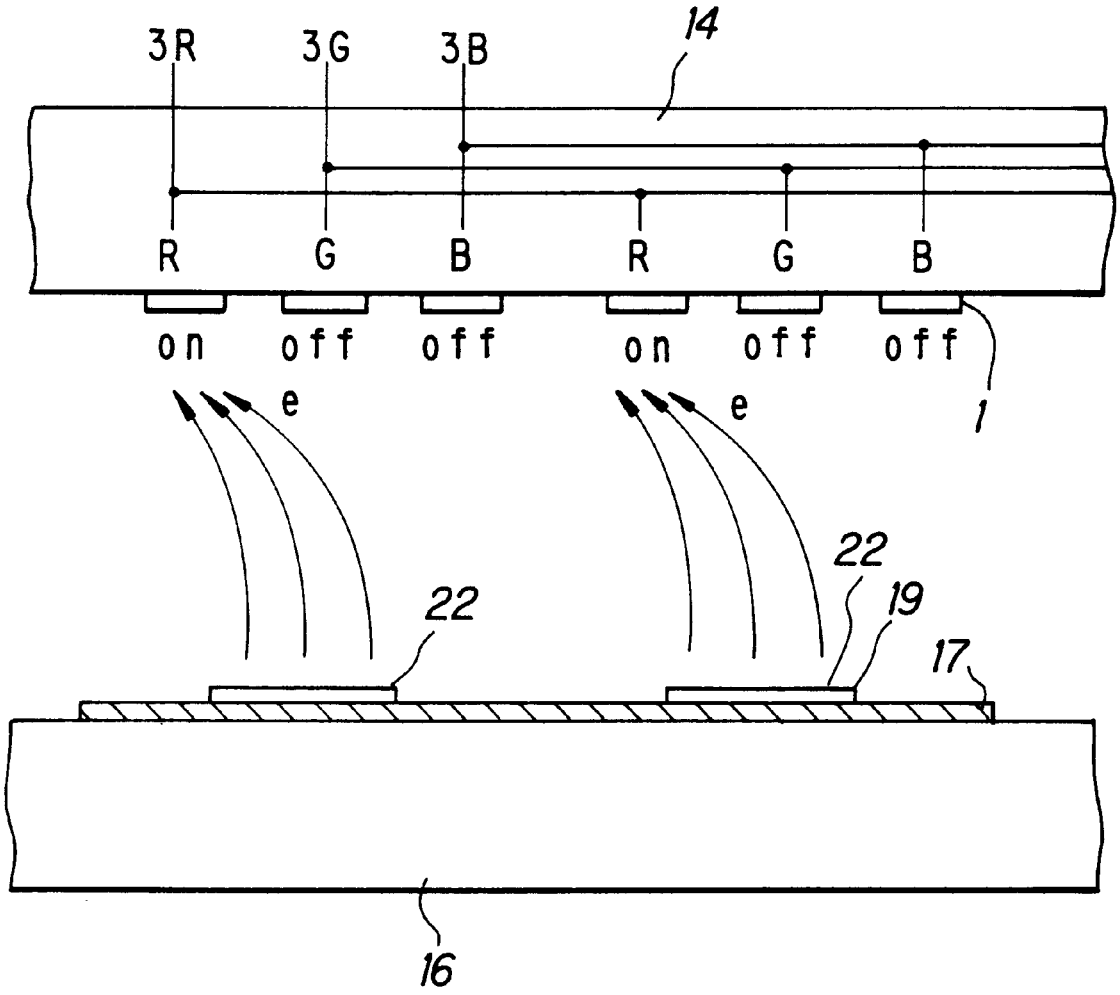
FIG. 21 is a view illustrating color selection by three terminal changeover between R, G, B.

In FIG. 21, fluorescent substances corresponding to the colors R, G, B are formed arrayed in order on a plurality of stripelike transparent electrodes 1 on the inner surface of a fluorescent screen panel 14, and the electrodes with the red, green and blue fluorescent substances thereon are respectively commonly connected to terminals 3R, 3G and 3B.

Cathode electrodes 17 and gate electrodes 19 perpendicular thereto are provided in stripe form on the facing rear panel 16 as described above, and when a field of strength $10^8$ to $10^9$ V/m is applied across the cathode electrodes 17 and the gate electrode 19 electrons are emitted from field emission cathodes 21 or 25 formed at the intersections 22 of the electrodes.

A voltage of 100 to 100 V is applied across the transparent electrodes 1 (the anode electrodes) and the cathode electrodes 17, and the electrons are thereby accelerated and strike the fluorescent substances and cause them to fluoresce. The example shown in FIG. 21 shows a case wherein a voltage is applied only on the red fluorescent substances R and the electrons are accelerated in the direction indicated by the arrow e.

Figure 22:
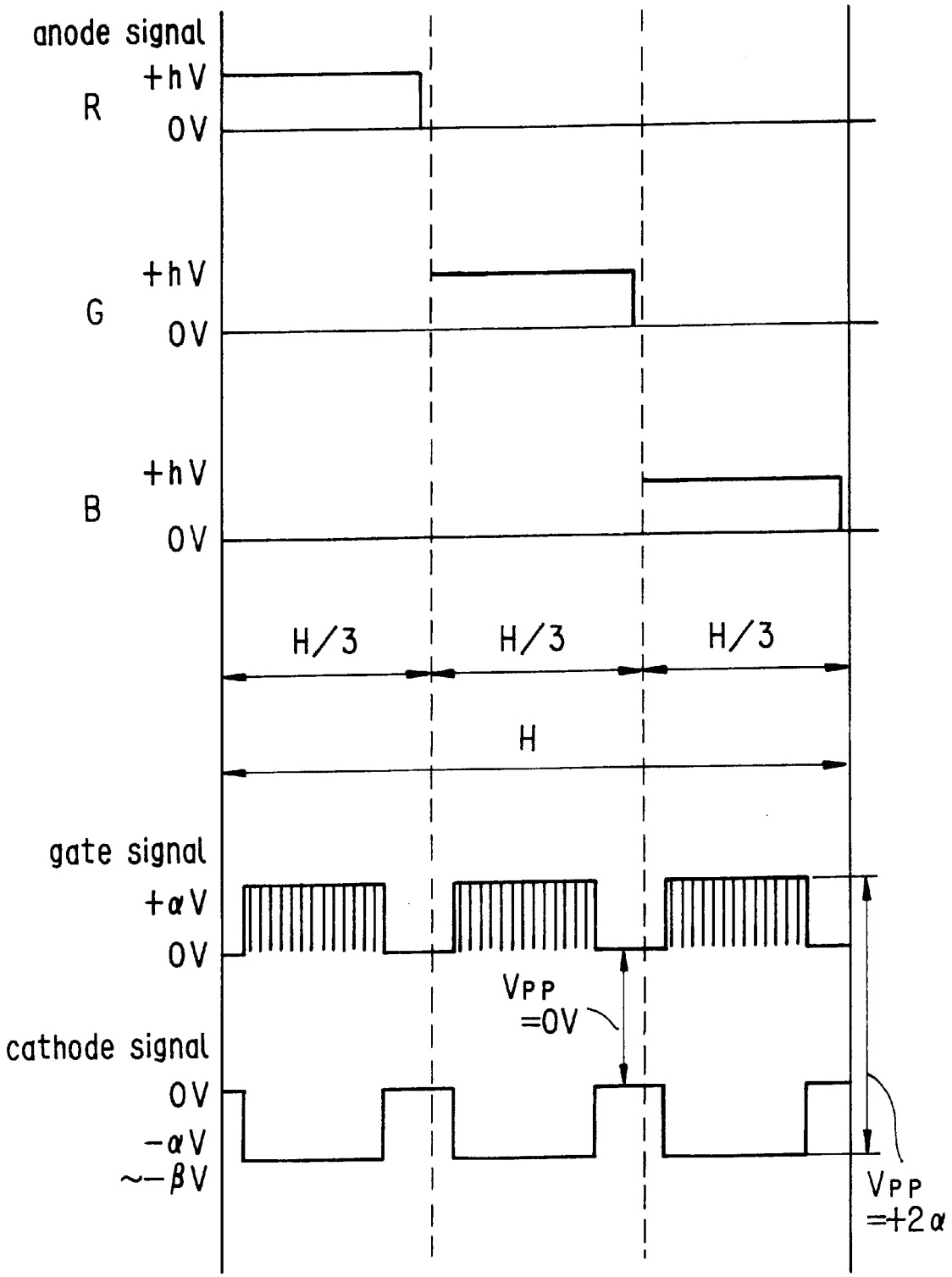
FIG. 22 is a timing chart of the same color selection.

By sequentially selecting the colors R, G and B commonly connected to the three terminals in this way, color display can be effected. A color selection timing chart for a certain cathode, gate and anode (fluorescent substance stripe) on each cathode electrode row in the NTSC system is shown in FIG. 22.

When the cathode electrodes 17 are driven in linear sequence with a period of 1H, the fluorescent substances R, G, B are fed a signal of +hV for H/3 of the period H each and the gate and cathode are respectively fed with a period of H/3 $+\alpha V$ as a gate signal and $-\alpha V$ to $-\beta V$ as a cathode signal; when the gate-cathode voltage $Vpp=+2\alpha V$, electrons are emitted and the fluorescent substances R, G, B selected every H/3 are made to fluoresce, whereby color selection can be carried out and in this way color display can be effected.

(forming a color fluorescent screen)

Next, an example of a method for forming the color fluorescent screen described above will be described. First, a transparent conductive layer of for example ITO is deposited on the entire inner surface of a fluorescent screen panel 14 for an FED by sputtering or electron beam thermal vapor deposition (EB vapor deposition), and then photoresist is coated over the whole of this transparent layer. Next, by lithography, using a pre-prepared chrome mask pattern (including a prescribed stripe pattern and a guard electrode pattern) the photoresist is exposed in a pattern by proximity or contact exposure using ultraviolet light, laser exposure, EB exposure or the like; developing, etching and photoresist removing steps are carried out and ITO transparent electrodes 1R, 1G, 1B to be electrodeposited on are thereby formed.

Figure 3:
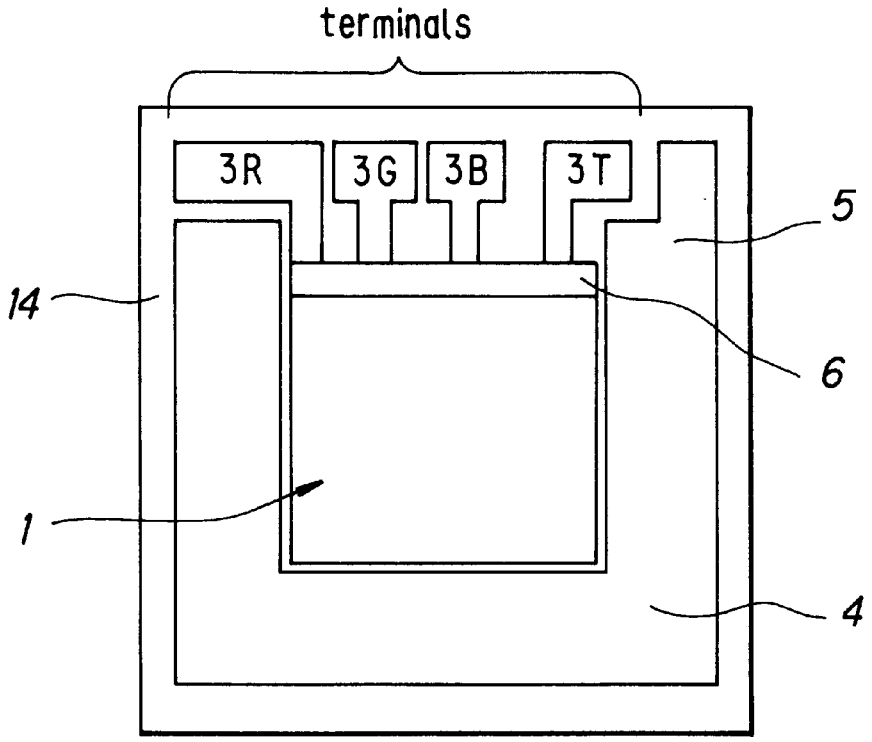
FIG. 3 is a schematic plan view of electrode patterns of the color fluorescent screen.

In FIG. 3 are shown a stripelike electrode area 1 and its readout terminal patterns 3R, 3G, 3B (these are common terminals of the electrodes of each color), and an inter-trio electrode readout terminal pattern 3T.

Figure 4:
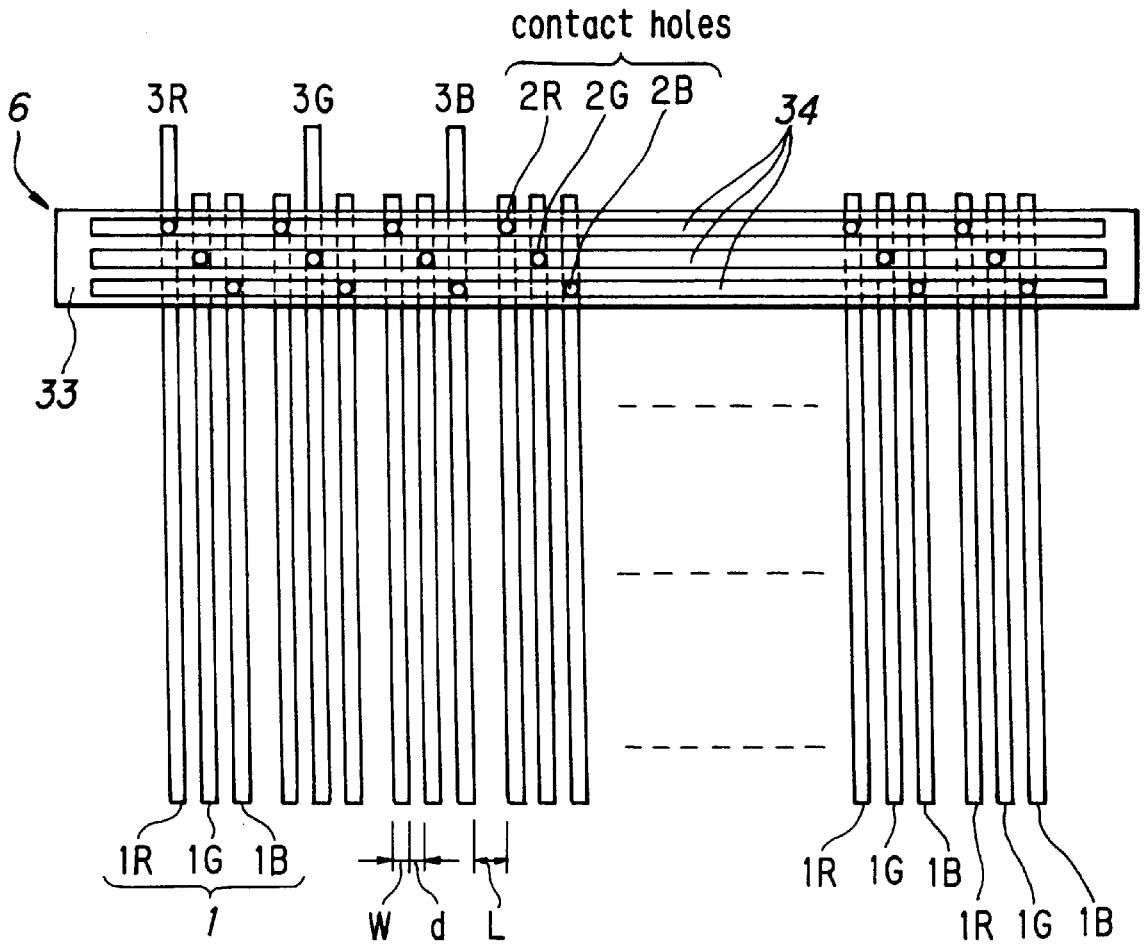
FIG. 4 is a schematic plan view of a leadout structure of electrode terminals in the color fluorescent screen.

A terminal leadout handling part 6 for the transparent electrodes 1R, 1G, 1B, for example as shown in FIG. 4, can be formed after the formation by sequential deposition of the stripelike transparent electrodes by commonly connecting the terminal parts of electrodes corresponding to the same color. That is, 3R, 3G and 3B denote common terminals of each color led out in correspondence with red, green and blue, and one electrode 1R, 1G or 1B among the transparent electrodes is made longer than the other electrodes and the terminals are led out every 1 trio. However, the leadout positions are not limited to this, and various changes such as making their spacing two trios are also possible.

Figure 5A:
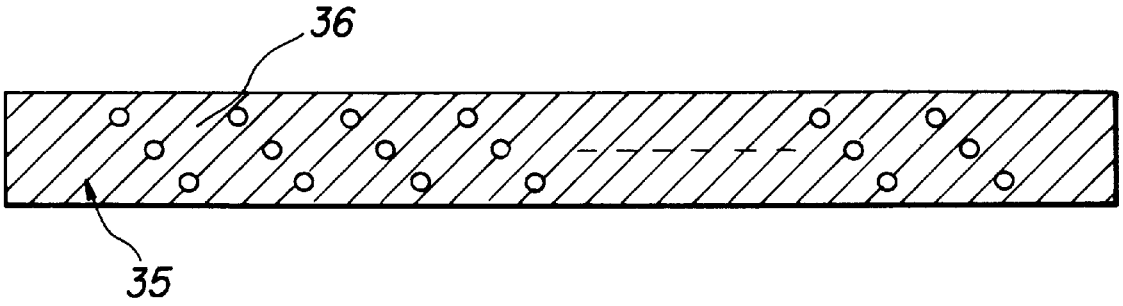
FIG. 5A and FIG. 5B are schematic plan views of masks used to form the leadout structure of the electrode terminals in the color fluorescent screen.

At one end of these stripe-form transparent electrodes, an insulating layer 33 extending in a direction perpendicular thereto made of glass paste or the like is formed by printing or the like, and for example contact holes 2R, 2G and 2B corresponding to the electrodes 1R, 1G, 1B are formed in this insulating layer 33. These contact holes can be patterned using a mask 35 having areas other than the contact holes 2R, 2G and 2B as a mask portion 36 as shown in FIG. 5A.

Figure 5B:
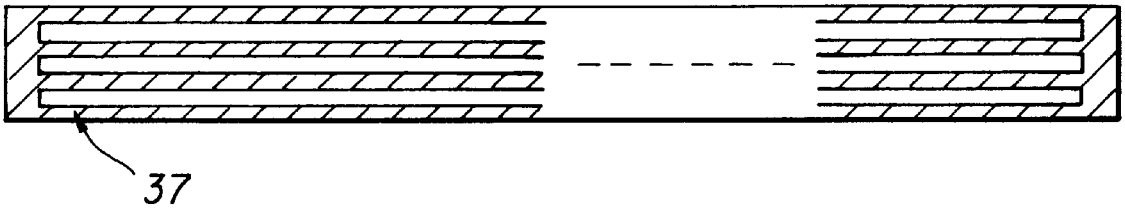

On this, a conductive material 34 consisting of a conductive metal or carbon paste or the like extending in a direction perpendicular to the transparent electrodes 1 can be patterned using for example a stripelike conductive material mask 37 shown in FIG. 5B formed by printing or the like. In this way the transparent electrodes 1R, 1G and 1B corresponding to the different colors can be electrically connected and the common terminals 3R, 3G and 3B led out.

In FIG. 3 and FIG. 4, the electrode width W of the stripe electrodes 1R, 1G and 1B for being electrodeposited on is 50 $\mu$m, the electrode spacing d is 50 $\mu$m, the spacing L between red, green and blue sets (trios) is 80 $\mu$m, and the distance between the guard electrode 4 and the edge of the stripe electrode area 1 adjacent thereto is 250 $\mu$m. Of course, the electrode width and the electrode spacing, the trio spacing and the distance between the guard electrode and the adjacent stripe electrodes are not limited, and in particular the width of the stripe electrodes for being electrodeposited on can be made narrower.

Figure 1:
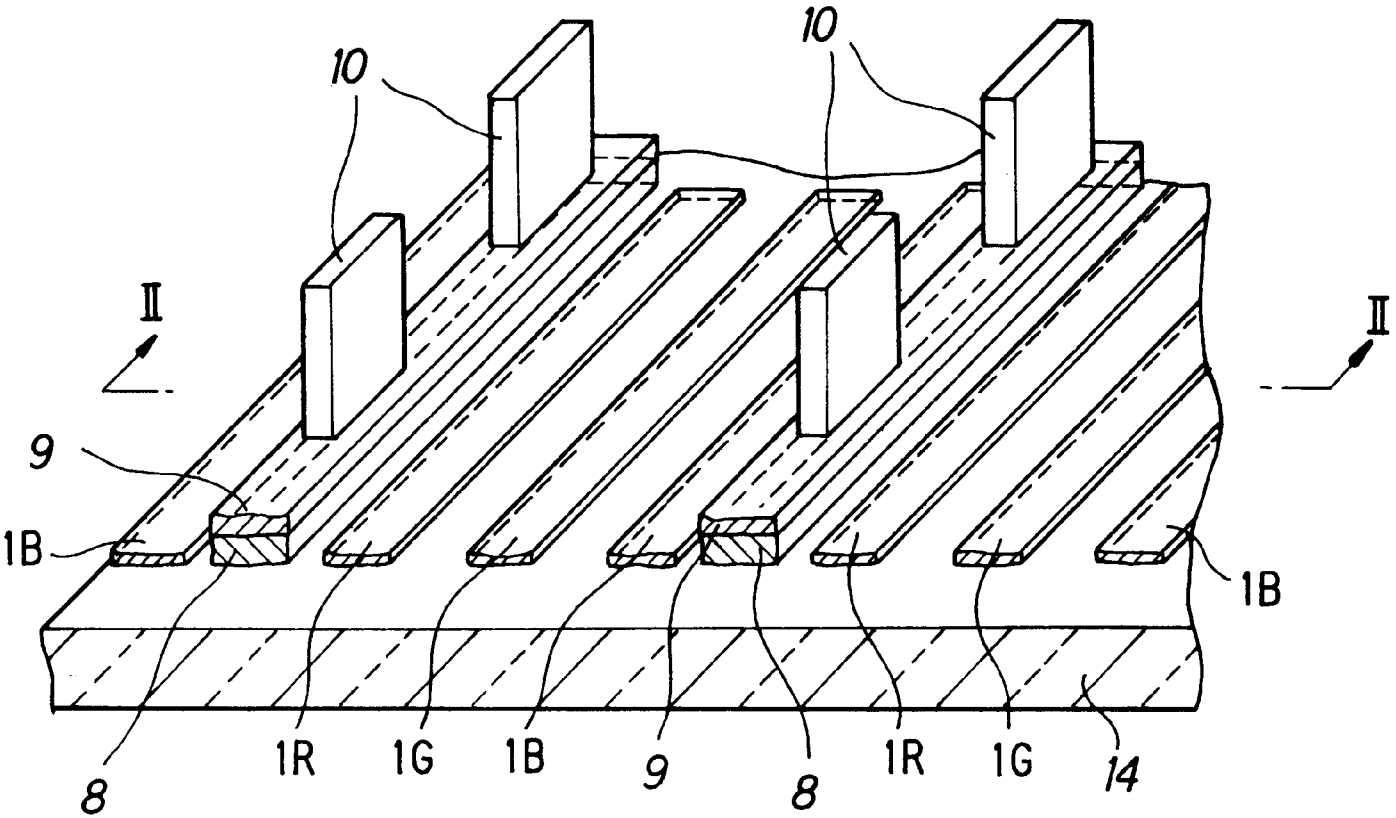
FIG. 1 is a schematic perspective view of electrode patterns of a color fluorescent screen according to a first preferred embodiment of the invention.
Figure 2:
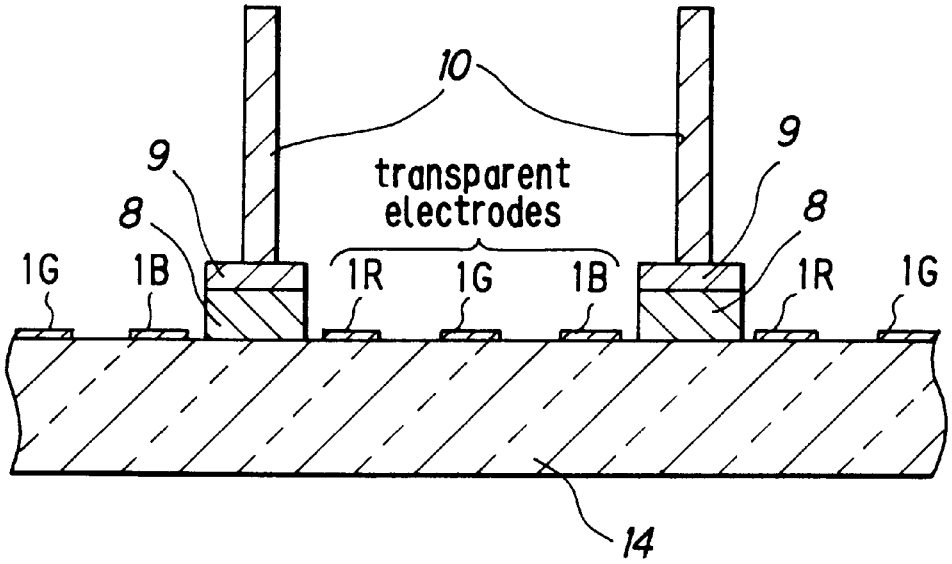
FIG. 2 is a sectional view on the line II—II in FIG. 1.

Next, as shown in FIG. 1 and FIG. 2, multifunctional two-layer films consisting of an insulating layer 8 and a conductive layer 9 are formed between the trios of stripe electrodes 1R, 1G, 1B for electrodeposition by multilayer printing or the like (preparation of inter-trio electrodes), and pillars 10 are further formed on these to a height of several 100 $\mu$m by the same multilayer printing method or the like.

Figure 6:
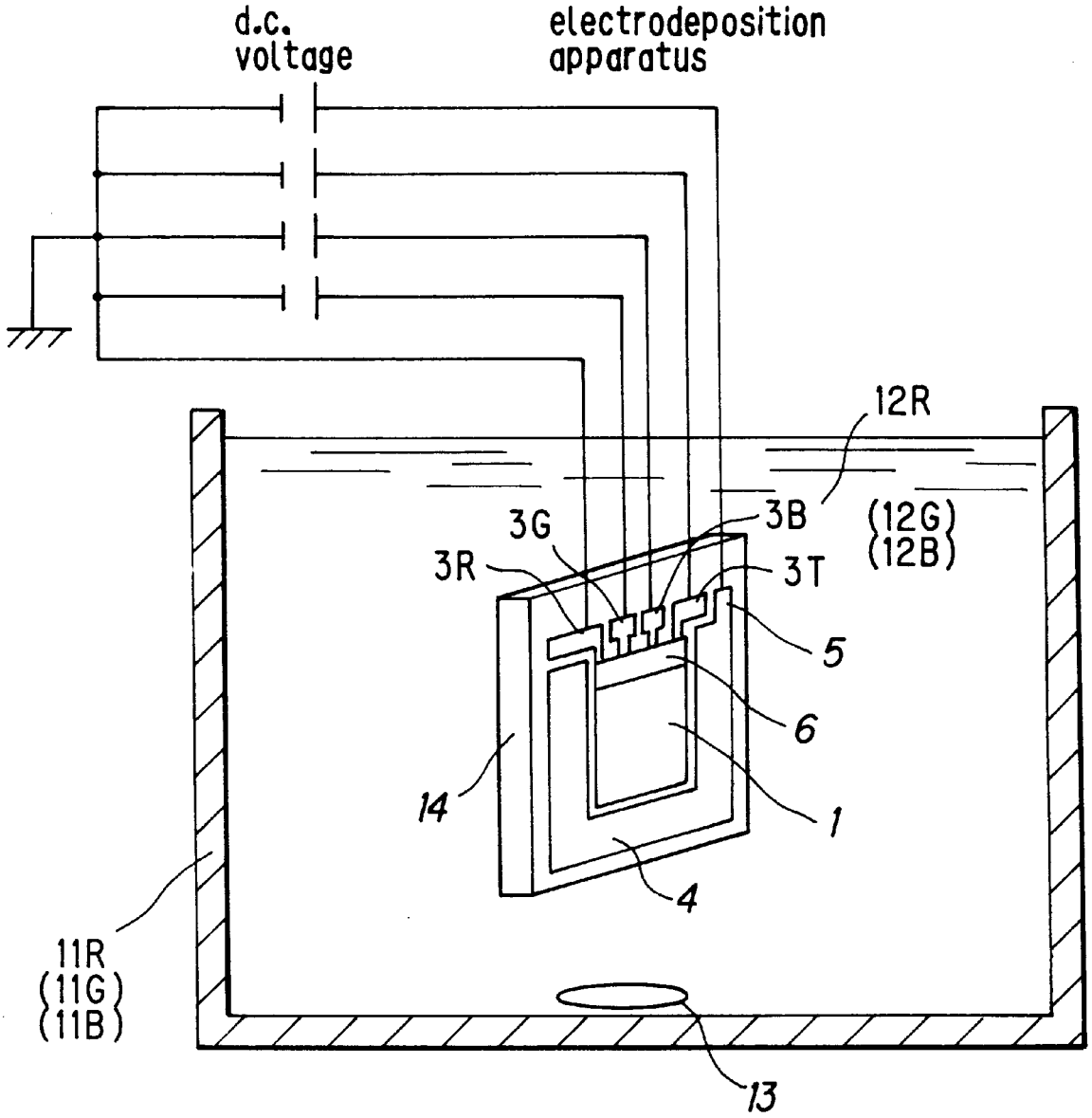
FIG. 6 is a schematic view of an electrodeposition apparatus for depositing fluorescent substances onto the color fluorescent screen.
Figure 7:
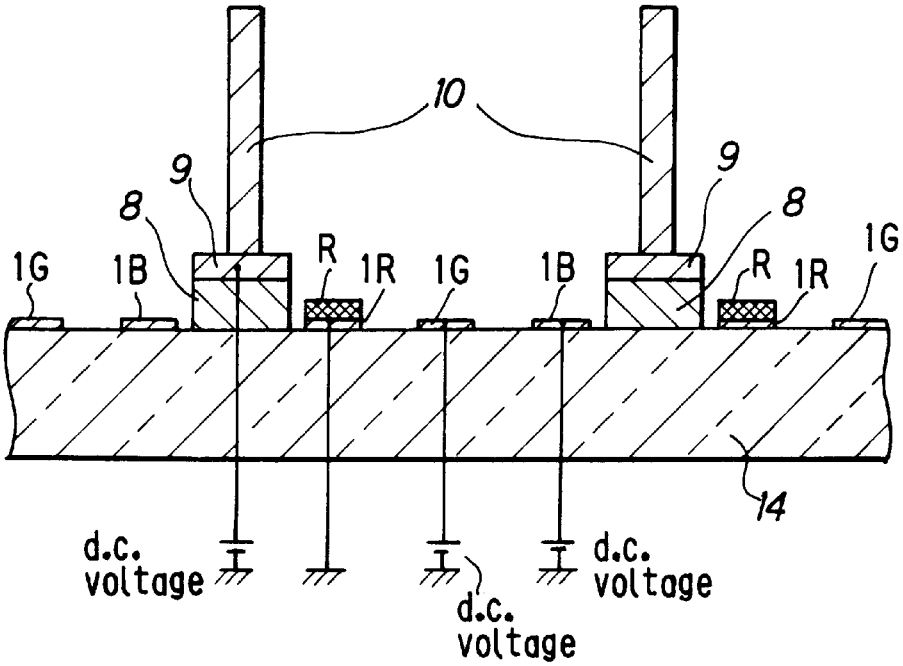
FIG. 7 is a sectional view showing a stage in the manufacturing process of the color fluorescent screen.

Next, as shown in FIG. 6, this panel is put into an electrodeposition tank 11 containing an electrodeposition solution in which is dispersed a fluorescent powder of a required color, and with the electrodeposition solution being uniformly stirred by a stirrer 13, electrodeposition of red, green and blue fluorescent substances onto the stripe-form transparent electrodes corresponding to the respective colors is carried out sequentially. Instead of the stirrer 13, stirring may be effected by stirring vanes or by pump circulation using a motor.

That is, first, the panel as shown for example in FIG. 1 and FIG. 2 is put into an electrodeposition tank 11R containing an electrodeposition solution 12R in which is dispersed a red fluorescent powder. In cathodic electrodeposition, an electrodeposition solution 12R containing 30 g of red fluorescent powder, 1 to $3\times10^{-7}$ mol/l of aluminum nitrate and lanthanum nitrate as electrolyte, up to 10 ml of glycerin as a dispersant and 1000 ml of isopropyl alcohol as a solvent is used.

Then, accurately (with fine control), through the terminal 3R the stripelike narrow transparent electrodes (the selected electrodes) 1R corresponding to the color red are given a negative potential, through the terminals 3G and 5 the stripelike electrodes 1G corresponding to the color green and the guard electrode 4 (these are equivalent to opposing electrodes) are given a zero or positive potential, through the terminals 3B and 3T the electrodes 1B for the color blue and the trio electrodes 9 are also given a zero or positive potential, and the red fluorescent powder is electrodeposited on the narrow electrodes 1R corresponding to the color red. This red fluorescent substance is selectively electrodeposited on the electrodes 1R only, and because the other stripe electrodes for electrodeposition are at a zero or positive potential and reverse-biased with respect to the electrodes 1R the red fluorescent substance does not adhere thereto, there are no mixed colors, and as a result a precise and uniform red fluorescent substance film R is formed. After that, the panel is cleaned with alcohol or the like and dried with warm air.

Figure 8:
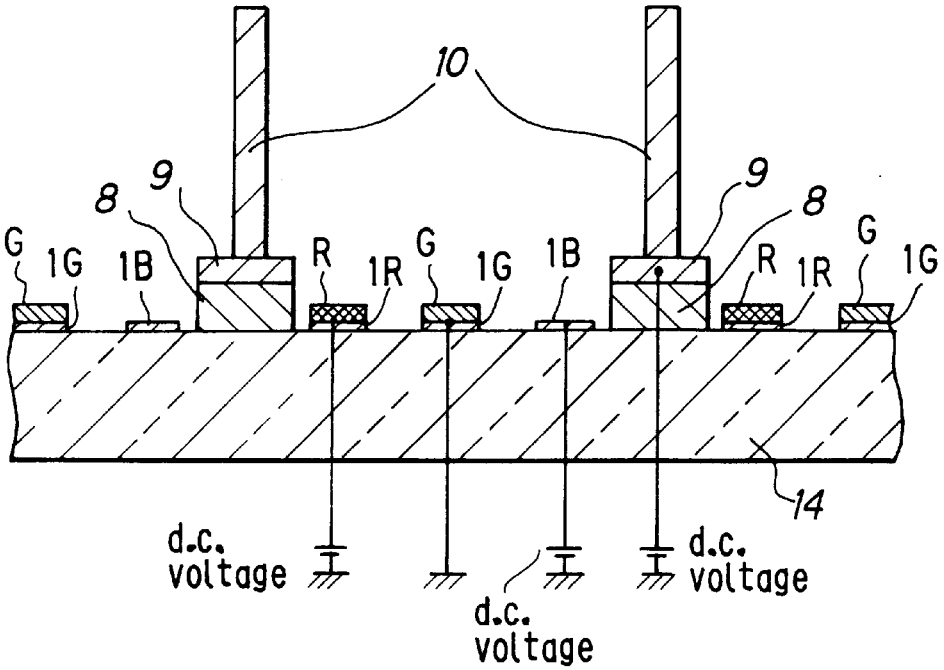
FIG. 8 is a sectional view showing another stage in the manufacturing process of the color fluorescent screen.

The panel 14 is then put in an electrodeposition solution 12G in which is dispersed a green fluorescent powder (of composition ratios substantially in accordance with the above-mentioned red fluorescent powder), through the terminal 3G the stripelike narrow transparent electrodes 1G (this time these are the selected electrodes) corresponding to the color green are given a negative potential, the stripelike electrodes 1R and 1B (the opposing electrodes) corresponding to the colors red and blue and the inter-trio electrodes 9 and the guard electrode 4 are given a zero or positive potential, and as shown in FIG. 8 the green fluorescent powder is electrodeposited on the narrow electrodes 1G corresponding to the color green, without mixed colors with the previously coated red fluorescent substance film R or the stripe electrodes 1B for the color blue, and a precise and uniform green fluorescent substance film G is formed. After that, the panel is cleaned with alcohol or the like and dried with warm air.

Figure 9:
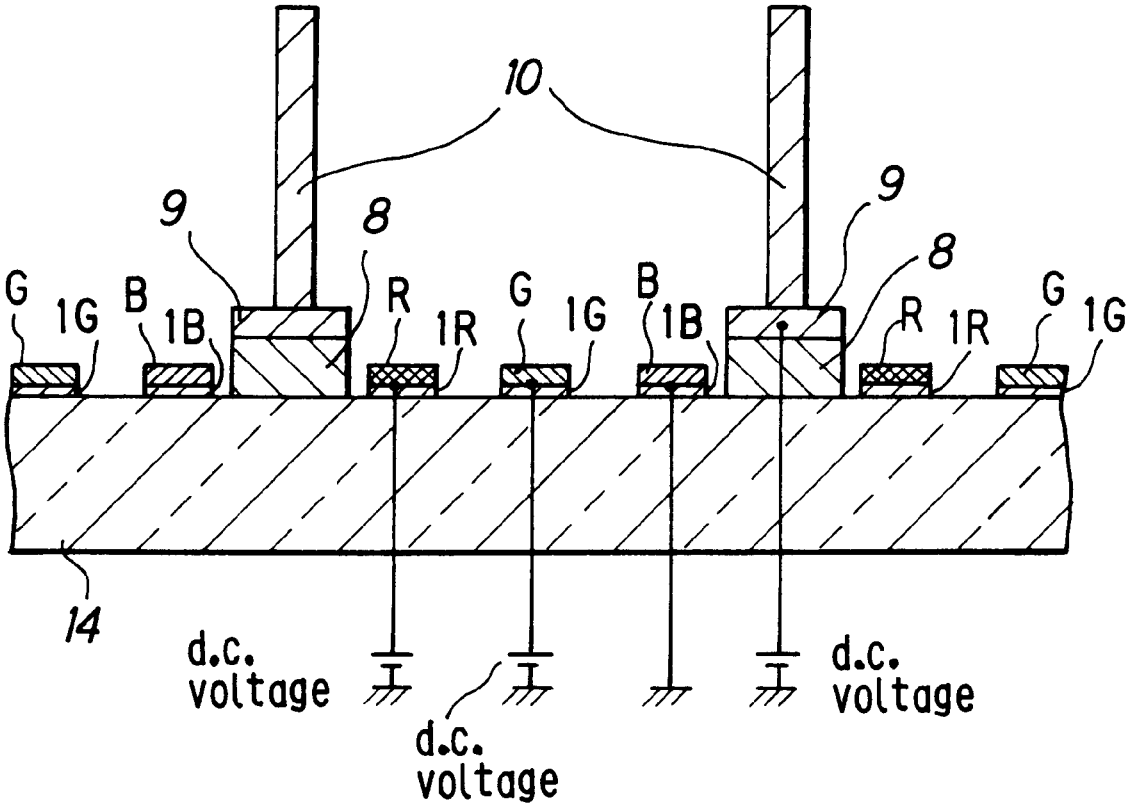
FIG. 9 is a sectional view showing another stage in the manufacturing process of the color fluorescent screen.

Then the panel 14 is put in an electrodeposition solution 12B in which is dispersed a blue fluorescent powder (of composition ratios substantially in accordance with the above-mentioned red fluorescent powder), through the terminal 3B the stripelike narrow transparent electrodes 1B corresponding to the color blue are given a negative potential, the electrodes 1G for the color green, the stripelike electrodes corresponding to the inter-trio electrodes 9 (the opposing electrodes) and the electrodes 1R for the color red and the guard electrode 4 are given a zero or positive potential, and as shown in FIG. 9 the blue fluorescent powder only is electrodeposited on the narrow electrodes 1B corresponding to the color blue, without any mixed colors whatsoever with the red and green fluorescent substance films R and G already deposited on the electrodes 1R and 1G (there is no deposition of fluorescent substance on the inter-trio electrodes), and a precise and uniform blue fluorescent substance film B is formed. After that, the panel is cleaned with alcohol or the like and dried with warm air.

Figure 10:
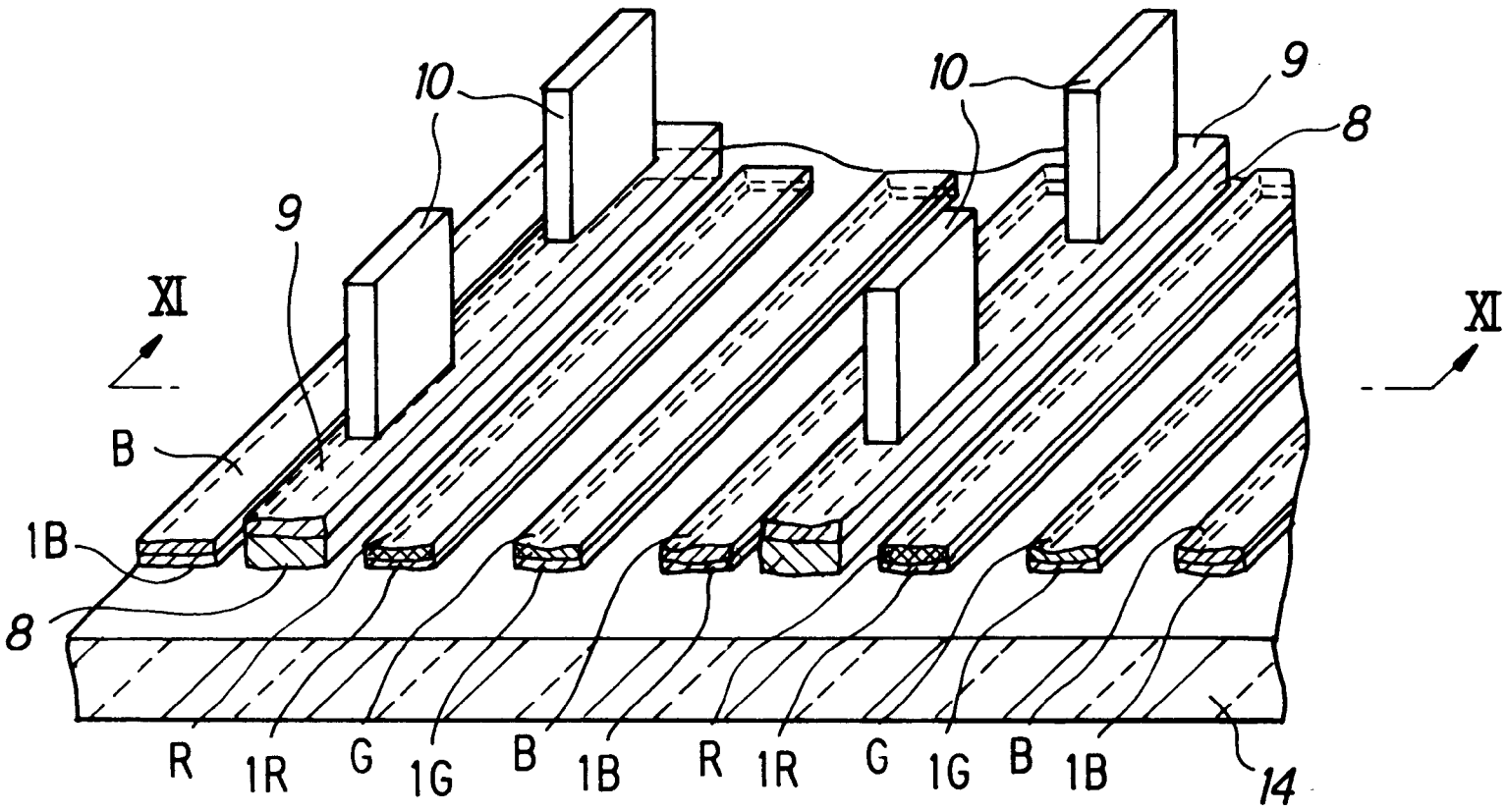
FIG. 10 is a schematic perspective view of the color fluorescent screen.
Figure 11:
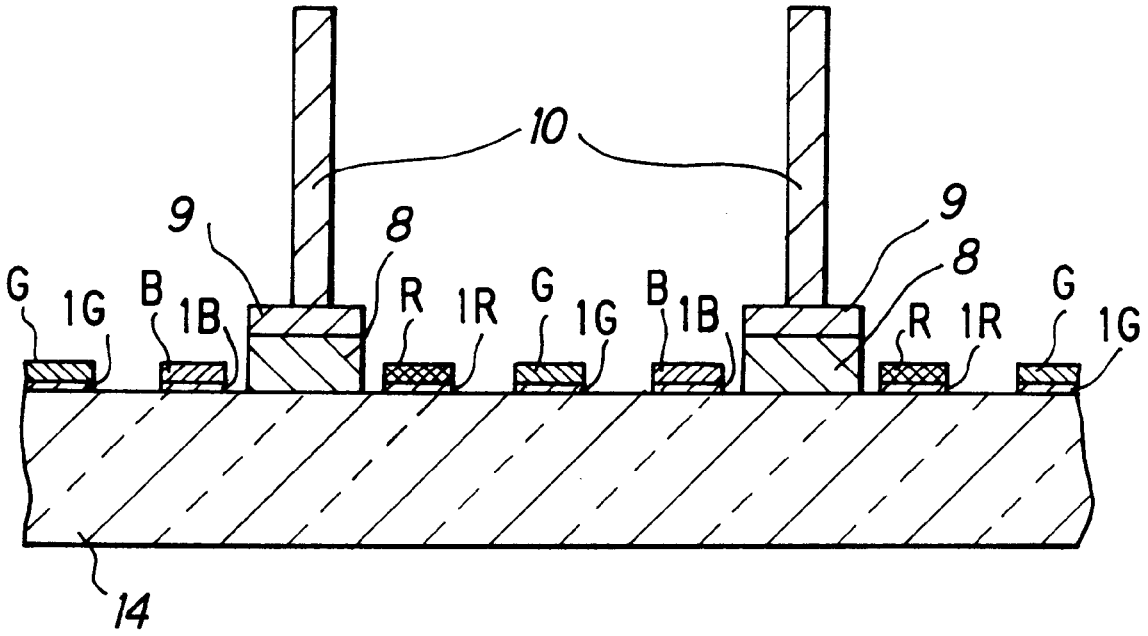
FIG. 11 is a sectional view on the line XI—XI in FIG. 10.

By the above process, as shown in FIG. 10 and FIG. 11, red, green and blue fluorescent substances R, G, B can be coated selectively onto the narrow stripe electrodes 1R, 1G and 1B respectively.

In cathodic electrodeposition it sometimes happens that electrolysis of water and the like and electrochemical reactions of electrolytes (free ions) at the cathode produce hydrogen and the like at the cathode side and reduce the ITO film; however, this can be avoided by pretreating the electrodeposition solution (water removal is effected by removal of $H_2$ by electrolysis treatment or the like, and electrolyte free ions such as $Al^{3+}$ and $La^{3+}$ are removed by exchange of the electrodeposition solution with a supernatant solution or the like).

In the process described above, the thicknesses of the deposited films of the fluorescent substances can be controlled by way of the electrodeposition time, the field strength, the amount of fluorescent substance and the stirring strength, and for example to deposit 15 $\mu$m of a fluorescent substance on ITO stripe electrodes (pitch 330 $\mu$m, stripe width 50 $\mu$m, distance between stripes 50 $\mu$m, distance between trios (red, green, blue) 80 $\mu$m, stripe thickness 200 to 300 nm, 145 stripe electrodes per color, 435 in total) on a 48 mm×48 mm effective screen, when the d.c. potential is 5 to 7.5 V, electrodeposition of 1 to 2 minutes is sufficient.

The reason why there is this range of voltages is that in electrodepositing the red, green and blue fluorescent substances the electrodes serving as the opposing electrodes are different in each case (the inter-electrode distance also changes). When coating the green fluorescent substance onto the central part of the stripe electrodes 1R, 1G, 1B for the colors red, green and blue, because the adjacent electrodes, i.e. the stripe electrodes 1R and 1B for red and blue, become opposing electrodes (the inter-electrode distance is the same), the same potential (about 7.5 V) should be applied to these electrodes.

For the other colors, by adjusting the potential according to the inter-electrode distance (finely adjusting to the optimum field strength), electrodeposition can be carried out with good precision (because the range of the potential difference applied to the opposing electrodes differs according to the inter-electrode distance, it is not possible to decide it univocally; however, it is at least under 500 V and preferably in the range 1 to 50 V).

As the fluorescent substances R, G, B used, for example as the red fluorescent substance there is $Y_2O_2S$: Eu, CdS, as the green fluorescent substance there is ZnS: Cu, Al, and as the blue fluorescent substance there are ZnS: Ag, Cl and ZnS: Ag, Al and the like, and apart from powders which easily solve out in solvents most other fluorescent substances can also be used. As the insulating layer 8 glass paste and as the conductive layer 9 aluminum paste are used in the preferred embodiment described above, but other materials may alternatively be used.

As described above, according to this invention, in forming a fluorescent screen for an FED, because electrodeposition wherein a finely controlled d.c. bias voltage is applied on non-selected electrode parts (electrodes for electrodeposition other than selected electrode parts (stripe electrodes for electrodeposition) provided on the same plane, or electrodes formed in advance between the electrodes for electrodeposition; these serve as opposing electrodes) is applied, the following marked benefits can be obtained:

(1) Adjacent electrode patterns (or may be electrode patterns on one side) can be made to act as opposing electrodes, and even if solid obstructions such as pillars are present it is possible to electrodeposit a coating onto prescribed electrodes and fluorescent substances which do not impair the level of a vacuum can be deposited.

(2) By applying a d.c. reverse bias potential on electrodes other than the selected electrodes (the opposing electrode voltage necessary for electrodeposition simultaneously is also the reverse bias voltage), even with electrodes of fine width and fine pitch, mixed colors and adhesion of the fluorescent substance to places such as between the stripe electrodes for electrodeposition can be prevented. The guard electrodes which are the non-effective screen part function as opposing electrodes (non-selected electrodes) and also have the original function of preventing the adhesion of fluorescent substance to the non-effective screen part.

(3) Because the electrodes are formed by photolithography or printing or the like, the precision of the inter-electrode distances is greatly increased, field strength control of the vicinities of the selected electrode parts can be carried out easily by fine control of the d.c. voltage, and it is possible to coat fluorescent substances uniformly on very fine (narrow) stripes.

(4) Because it is possible to dispose the selected electrodes and the opposing electrodes on the same fluorescent screen panel surface, the electrodeposition tank and the electrodeposition apparatus can be made thin and less electrodeposition solution need be used. Also, because less solution is used, uniform stirring becomes easy.

It is advantageous if a three terminal arrangement is adopted as described above with reference to the terminals 3R, 3G and 3B in FIG. 21, because then it is possible to realize both easy sequential R, G, B color electrodeposition and color display by sequential color selection for an FED.

FIG. 23 through FIG. 28 show a second preferred embodiment of the invention applied to the uniform formation of a very fine color fluorescent screen.

Figure 23:
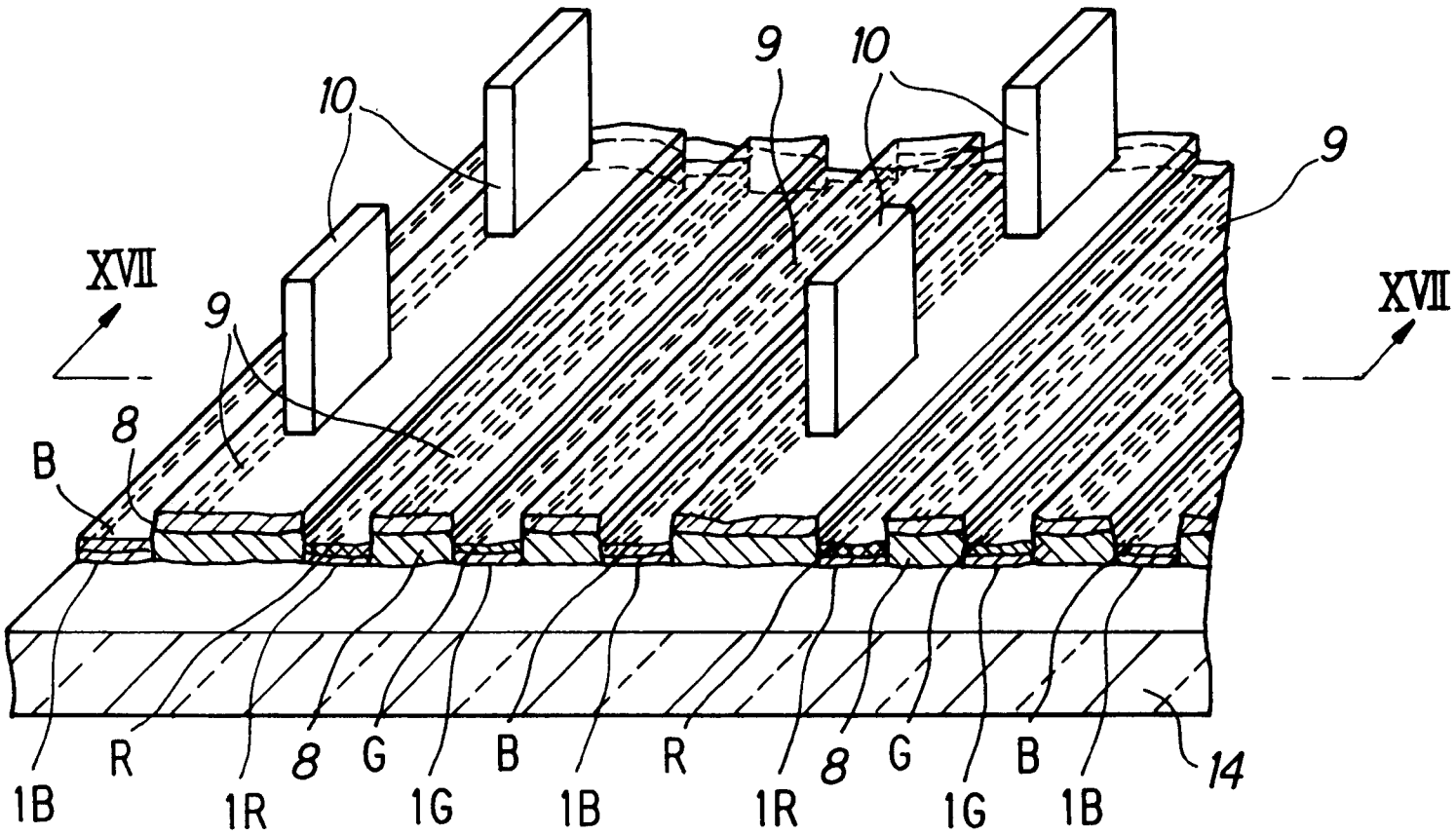
FIG. 23 is a schematic perspective view of a color fluorescent screen according to a second preferred embodiment of the invention.
Figure 24:
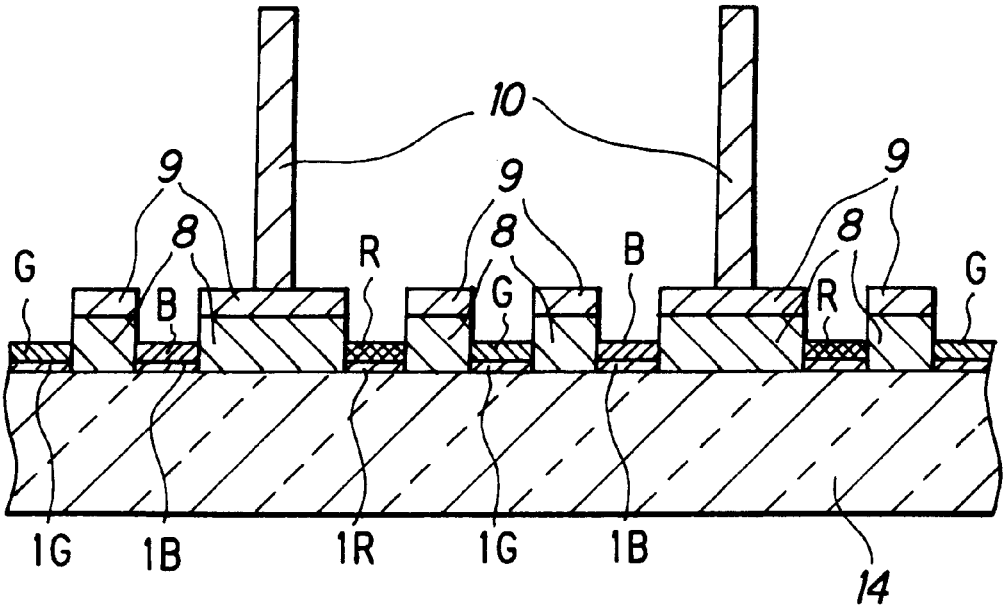
FIG. 24 is a sectional view on the line XVII—XVII in FIG. 23.
Figure 25:
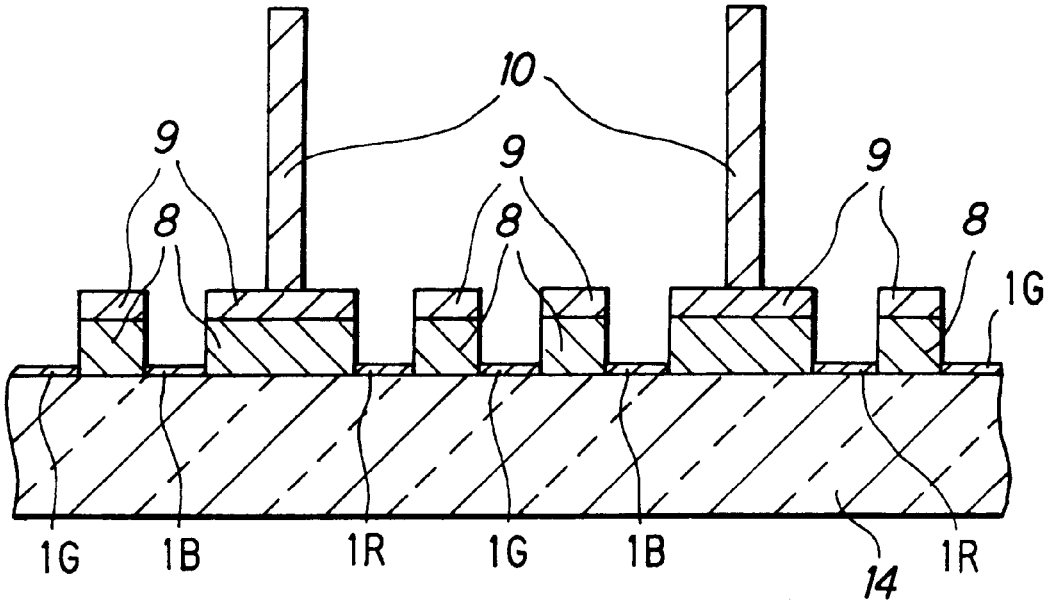
FIG. 25 is a sectional view showing a stage in the manufacturing process of this color fluorescent screen.

In the fluorescent screen panel according to this preferred embodiment, as shown in FIG. 23 and FIG. 24, differently from the example shown in FIG. 10 and FIG. 11, the insulating layer 8 and the electrodes 9 are layered in stripe form between the electrodes 1R, 1G, 1B also.

As shown in FIG. 25 through FIG. 28, when sequentially electrodepositing fluorescent substances R, G, B on the electrodes 1R, 1G, 1B, together with the multifunctional two-layer film with the pillars 10 thereon this multifunctional two-layer film between the stripe electrodes 1R, 1G, 1B is used as opposing electrodes on which is applied a zero or positive d.c. reverse bias voltage.

As a result, it is possible to selectively coat a fluorescent substance onto only the electrodes 1R, 1G or 1B with better fine control of the field. This is because by applying a reverse bias voltage also across the non-selected of the electrodes 1R, 1G, 1B and the electrodes of the multifunctional two-layer film between them, adhesion of fluorescent powder to the adjacent electrodes can be completely prevented.

Figure 26:
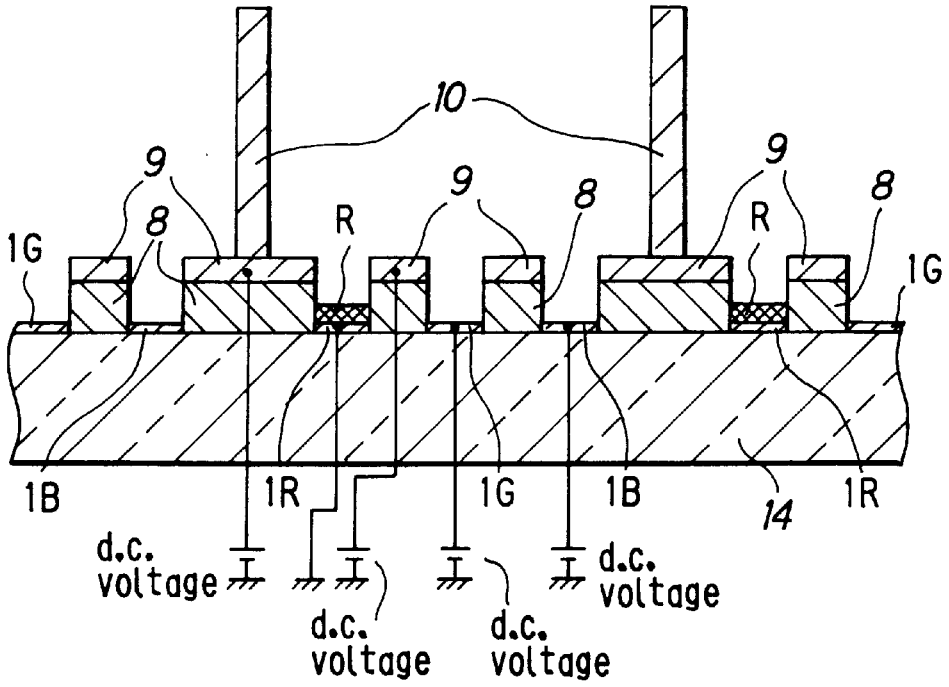
FIG. 26 is sectional view showing another stage in the manufacturing process of this color fluorescent screen.
Figure 27:
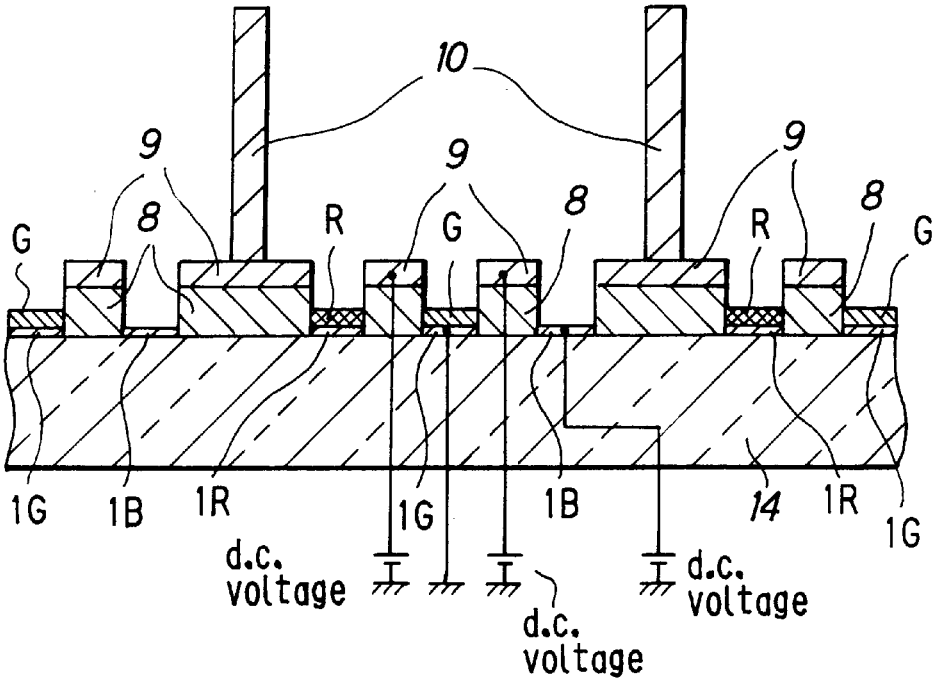
FIG. 27 is sectional view showing another stage in the manufacturing process of this color fluorescent screen.
Figure 28:
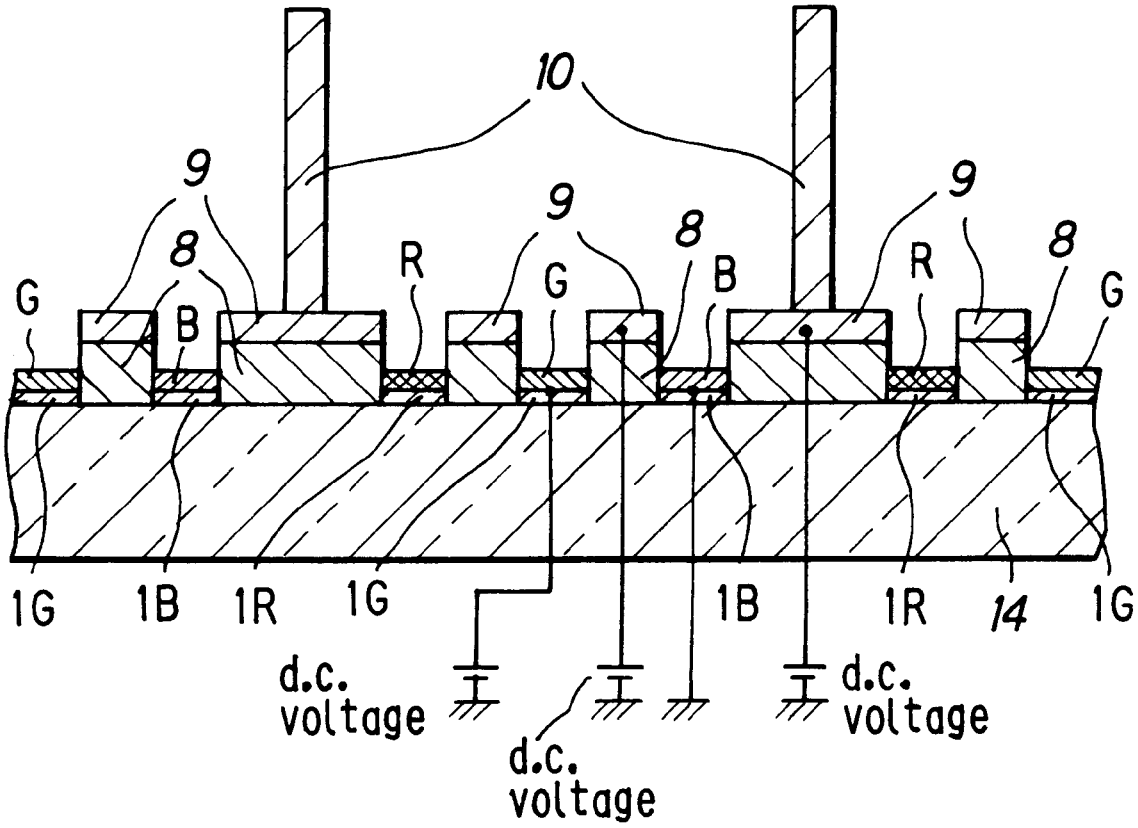
FIG. 28 is a sectional view showing another stage in the manufacturing process of this color fluorescent screen.

For example, as shown in FIG. 26, when electrodepositing the red fluorescent substance R, by giving the electrodes 1R a negative potential and the electrodes 1G, 1B and 9 a zero or positive potential, the fluorescent substance R can be selectively electrodeposited on the electrodes 1R only. The other fluorescent substances G and B can be electrodeposited in the same way, as shown in FIG. 27 and FIG. 28.

Figure 29:
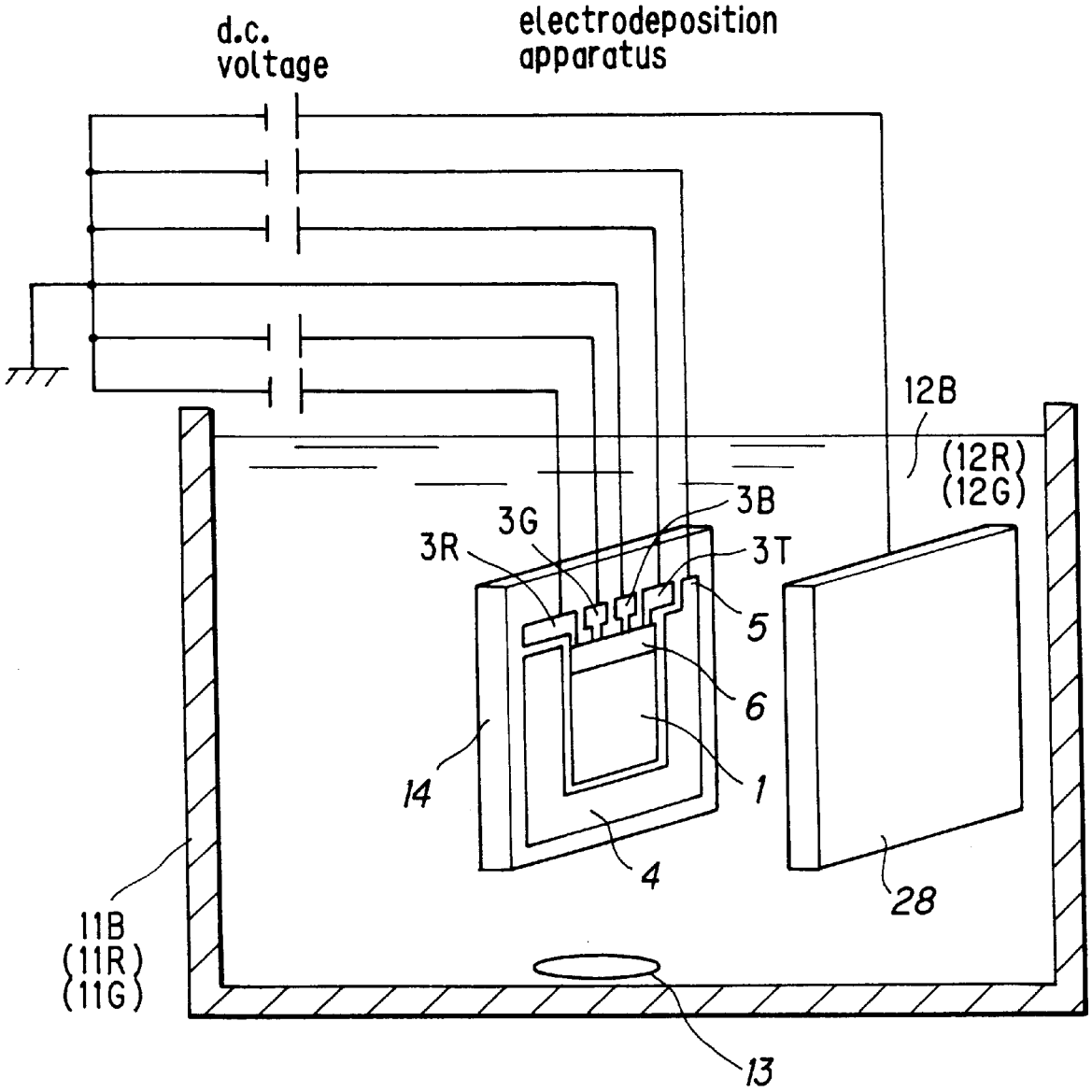
FIG. 29 is a schematic view of an electrodeposition apparatus for depositing fluorescent substances on a color fluorescent screen according to a third preferred embodiment of the invention.

FIG. 29 shows a third preferred embodiment of the invention applied to the uniform formation of a very fine color fluorescent screen.

In this preferred embodiment, differently from the electrodeposition apparatus shown in FIG. 6, an electrode 28 is disposed in the electrodeposition solution facing the fluorescent screen panel 14 across a predetermined gap as a opposing electrode, and electrodeposition of a fluorescent substance of a prescribed color is carried out with a reverse bias voltage also applied on this electrode 28.

By applying a bias voltage on the opposing electrode 28 disposed separately from the fluorescent screen panel 14, the freedom with which the field strength in the vicinity of the selected electrodes can be controlled is increased and a finer fluorescent screen can be formed.

Preferred embodiments of the invention are described above, but these preferred embodiments can be variously changed based on the technological concept of the invention.

For example, the above-mentioned fluorescent substances and patterns and layout of electrodes for electrodeposition may be variously changed, and instead of the black stripes a black matrix may be adopted. The colors and the number of colors used may also be freely changed.

Also, the above-mentioned electrodeposition conditions, and particularly the applied voltages and times, may be changed according to the constitution of the device being made and other factors.

This invention is suitable for application to an FED, but it can also be applied to displays of other types and has a wide range of applications.

Because as described above in this invention a plurality of first electrodes on which a plurality of fluorescent substances are to be deposited and second electrodes and between these electrodes on which no fluorescent substances are to be deposited are provided on a common base and prescribed electrodes among the plurality of first electrodes are selected and electrodeposition treatment is carried out in an electrodeposition solution with the electrodes other than these selected electrodes being used as opposing electrodes and the fluorescent substances are thereby deposited on the selected electrodes, the following marked benefits can be obtained:

(1) Adjacent electrode patterns (or may be electrode patterns on one side) can be made to act as opposing electrodes, and even if solid obstructions such as pillars are present it is possible to electrodeposit a coating onto prescribed electrodes and fluorescent substances which do not impair the level of a vacuum can be electrodeposited.

(2) By applying a d.c. reverse bias voltage on electrodes other than the selected electrodes, even with electrodes of fine width and fine pitch, mixed colors and adhesion of the fluorescent substance to places such as between the stripe electrodes for electrodeposition can be prevented.

(3) Because the electrodes are formed by photolithography or printing or the like, the precision of the inter-electrode distances is greatly increased, field control of the vicinities of the selected electrode parts can be carried out easily by fine control of the d.c. voltage, and it is possible to coat fluorescent substances uniformly on very fine (narrow) stripes.

(4) Because it is possible to dispose the selected electrodes and the opposing electrodes on the same surface of the fluorescent screen panel, the electrodeposition tank and the electrodeposition apparatus can be made thin and less electrodeposition solution need be used. Also, because less solution is used, uniform stirring becomes easy.

What is claimed is:

1. A manufacturing method for a fluorescent screen display, comprising the steps of: forming on a common base a plurality of groups of first electrodes which subsequently have a plurality of fluorescent substances respectively deposited separately on individual ones of the first electrodes;

forming on the common base an insulating layer between each of the groups of the first electrodes;

forming on each insulating layer a second electrode not having fluorescent substances deposited thereon;

selecting a first collection of electrodes among the plurality of first electrodes, the first collection including an electrode from each group, and depositing the first of the plurality of fluorescent substances onto the selected first collection of electrodes by carrying out electrodeposition in an electrodeposition solution with the electrodes other than the selected electrodes as electrically opposing electrodes including the second electrode on each insulating layer; and repeating the selecting and depositing steps for a different collection of first electrodes for each of the remaining plurality of fluorescent substances.

2. A manufacturing method according to claim 1, wherein in a nonaqueous or aqueous electrodeposition solution a variable voltage is applied on the selected first collection of electrodes to control the electrical field in the vicinity of these first electrodes.

3. A manufacturing method according to claim 2, wherein a reverse bias voltage is applied on the electrodes other than the selected first collection of electrodes.

4. A manufacturing method according to claim 3, wherein a third electrode is disposed facing the common base on which the first electrodes and the second electrodes are formed with a predetermined gap provided therebetween and a reverse bias voltage is applied on this third electrode.

5. A manufacturing method according to claim 1, wherein pretreatment to prevent deterioration of the first electrodes is carried out on at least one of the electrodeposition solution.

6. A manufacturing method according to claim 1, wherein the first electrodes and the second electrodes are formed by lithography or printing on the common base on an inner side of a common fluorescent panel.

7. A manufacturing method according to claim 1, comprising the additional step of:

forming pillars on top of the second electrodes for supporting a vacuum within the flourescent screen structure.

* * * * *